US009227435B2

(12) United States Patent
Ito et al.

(10) Patent No.: US 9,227,435 B2
(45) Date of Patent: Jan. 5, 2016

(54) INK-JET RECORDING APPARATUS AND PLATEN APPARATUS

(71) Applicant: Brother Kogyo Kabushiki Kaisha, Nagoya-shi, Aichi-ken (JP)

(72) Inventors: Tsuyoshi Ito, Nagoya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/588,535

(22) Filed: Jan. 2, 2015

(65) Prior Publication Data

US 2015/0109394 A1 Apr. 23, 2015

Related U.S. Application Data

(63) Continuation of application No. 14/190,793, filed on Feb. 26, 2014, now Pat. No. 8,926,088, which is a continuation of application No. 13/630,199, filed on Sep. 28, 2012, now Pat. No. 8,696,110.

(30) Foreign Application Priority Data

Nov. 28, 2011 (JP) ..... 2011-259499

(51) Int. Cl.

| | |
|---|---|
| ***B41J 11/00*** | (2006.01) |
| ***B41J 11/04*** | (2006.01) |
| ***B41J 11/06*** | (2006.01) |
| ***B41J 11/20*** | (2006.01) |

(Continued)

(52) U.S. Cl.

CPC *B41J 11/04* (2013.01); *B41J 11/06* (2013.01); *B41J 11/20* (2013.01); *B41J 11/00* (2013.01); *B41J 11/02* (2013.01); *B41J 11/08* (2013.01)

(58) Field of Classification Search

USPC ..... 347/104, 220, 218

See application file for complete search history.

(56) References Cited

U.S. PATENT DOCUMENTS

| | | | | |
|---|---|---|---|---|
| 6,616,361 | B2 * | 9/2003 | Sugiyama | 400/642 |
| 6,712,463 | B2 | 3/2004 | Matsumoto | |
| 6,896,432 | B2 | 5/2005 | Ohyama | |

(Continued)

FOREIGN PATENT DOCUMENTS

| | | |
|---|---|---|
| CN | 1727193 A | 2/2006 |
| CN | 1727195 A | 2/2006 |

(Continued)

OTHER PUBLICATIONS

Computer-generated translation of Jp 2000-071532, published on Mar. 2000.*

(Continued)

*Primary Examiner* — Huan Tran

(74) *Attorney, Agent, or Firm* — Banner & Witcoff, Ltd.

(57) ABSTRACT

There is provided an ink-jet recording apparatus including: a platen, a contact portion disposed between a pair of first ribs of the plurality of first ribs with respect to a scanning direction. A lower end of the contact portion is located lower than each upper end of the pair of first ribs. The platen includes a second rib disposed between one first rib of the pair of first ribs and the contact portion with respect to the scanning direction, and an upper end of the second rib is located lower than the upper end of the one first rib of the pair of first ribs and higher than the lower end of the contact portion.

8 Claims, 13 Drawing Sheets

(51) Int. Cl.
*B41J 11/02* (2006.01)
*B41J 11/08* (2006.01)

(56) References Cited

U.S. PATENT DOCUMENTS

| | | | | |
|---|---|---|---|---|
| 7,232,369 | B2 | 6/2007 | Karidis et al. | |
| 7,641,408 | B2 | 1/2010 | Niikura et al. | |
| 7,806,524 | B2 | 10/2010 | Watanabe et al. | |
| 8,256,764 | B2 | 9/2012 | Imoto | |
| 8,696,110 | B2 * | 4/2014 | Ito et al. | 347/104 |
| 8,926,088 | B2 * | 1/2015 | Ito et al. | 347/104 |
| 2002/0067942 | A1 * | 6/2002 | Sugiyama | 400/578 |
| 2003/0025777 | A1 | 2/2003 | Sugiyama | |
| 2003/0048345 | A1 | 3/2003 | Matsumoto | |
| 2004/0126164 | A1 | 7/2004 | Ohyama | |
| 2005/0168557 | A1 | 8/2005 | Ohyama | |
| 2006/0023052 | A1 | 2/2006 | Watanabe et al. | |
| 2006/0024118 | A1 | 2/2006 | Niikura et al. | |
| 2009/0121422 | A1 | 5/2009 | Imoto | |
| 2011/0001778 | A1 | 1/2011 | Kanda et al. | |
| 2012/0292848 | A1 | 11/2012 | Imoto | |
| 2013/0135388 | A1 | 5/2013 | Samoto et al. | |
| 2013/0135389 | A1 | 5/2013 | Ito et al. | |
| 2013/0135409 | A1 | 5/2013 | Ito et al. | |
| 2013/0135413 | A1 | 5/2013 | Ito et al. | |
| 2014/0240427 | A1 | 8/2014 | Ito et al. | |

FOREIGN PATENT DOCUMENTS

| | | | |
|---|---|---|---|
| CN | 1907721 | A | 2/2007 |
| CN | 202895929 | U | 4/2013 |
| JP | H10-071711 | A | 3/1998 |
| JP | H11-138923 | A | 5/1999 |
| JP | 2000-071532 | A | 3/2000 |
| JP | 2000-158644 | A | 6/2000 |
| JP | 2006/143477 | A | 6/2006 |
| JP | 2008-001522 | A | 1/2008 |
| JP | 2008132613 | A | 6/2008 |

OTHER PUBLICATIONS

Notification of First Office Action in Chinese Patent Applicaiton No. 201210380684.3 mailed Sep. 2, 2014.

Dec. 24, 2014—(JP) Notice of Reasons for Rejection—App 2011-259499.

* cited by examiner

INK-JET RECORDING APPARATUS AND PLATEN APPARATUS

CROSS REFERENCE TO RELATED APPLICATION

The present application is a continuation application of U.S. Ser. No. 14/190,793, filed Feb. 26, 2014, which is a continuation of U.S. Ser. No. 13/630,199, filed Sep. 28, 2012, issued as U.S. Pat. No. 8,696,110, which claims priority from Japanese Patent Application No. 2011-259499, filed on Nov. 28, 2011, the disclosures of which are incorporated herein by reference in their entirety.

BACKGROUND OF THE INVENTION

1. Field of the Invention

The present invention relates to an ink-jet recording apparatus which is configured to transport a sheet made to be in an undulant state (form of a wave) and to record an image thereon, and a platen apparatus.

2. Description of the Related Art

There has been known an ink-jet recording apparatus in which a transported sheet is supported by a platen and ink droplets are jetted to the sheet supported by the platen from a recording head to record an image. In some ink-jet recording apparatuses in this type, the sheet made to be in a undulant state is transported so that the sheet is prevented from floating from the platen at the time of recording the image.

The above described ink-jet recording apparatus is provided with a plurality or ribs provided in the platen and a holding plate for a recording sheet provided at an upstream side of the recording head in a transport direction. The ribs are disposed parallel to each other in the transport direction. Each recess is provided between the ribs. The holding plate for the recording sheet includes a plurality of projections protruding in the respective recesses. In a case that the sheet passes between each rib and each projection, the sheet is held, in mutually opposite directions, by each rib and each projection. Accordingly, the sheet is made to be in the undulant state.

SUMMARY OF THE INVENTION

In a case that the sheet is made to be in the undulant state, a distance between the sheet and the recording head continuously changes in a width direction perpendicular to the transport direction. It is possible to consider that accuracy of image recording is improved by jetting the ink droplets from the recording head taking the continuous distance change into consideration. In this case, the more uniform rigidity of the sheet in the undulant state in the width direction, the less likely that there is generated a difference between an estimated distance and an actual distance between the sheet and the recording head. Accordingly, the accuracy of image recording is improved. However, using only the ribs is not sufficient to uniform the rigidity of the sheet in the width direction.

The present teaching has been made taking the foregoing problem into consideration, an object of the present teaching is to provide a mechanism which is capable of improving uniformity of rigidity of a sheet in a width direction.

According to a first aspect of the present teaching, there is provided an ink-jet recording apparatus including:

a platen including a plurality of first ribs; and a contact portion disposed between a pair of first ribs of the plurality of first ribs with respect to a scanning direction, a lower end of the contact portion being located lower than each upper end of the pair of first ribs, wherein the platen further includes a second rib disposed between one first rib of the pair of first ribs and the contact portion with respect to the scanning direction, and an upper end of the second rib is located lower than the upper end of the one first rib of the pair of first ribs and higher than the lower end of the contact portion.

In a case that the sheet passes through each of the contact portions, the transported sheet is held, in mutually opposite directions, by each first rib and each contact portion. The sheet is made to be in the undulant state in which portions supported by the first ribs are "peak" shaped and portions forced downward by the contact portions are "valley" shaped. In a case that the sheet is made to be in the undulant state, the second rib supports a part of the sheet to adjust the waveform. Accordingly, the uniformity of rigidity of the sheet in the width direction is improved.

According to a second aspect of the present teaching, there is provided a platen apparatus including:

a plurality of first ribs;

a plurality of second ribs, each having a height smaller than a height of each of the plurality of first ribs;

a first portion defined between a first pair of first ribs of the plurality of first ribs and a first number of second ribs of the plurality of second ribs disposed between the first pair of first ribs; and a second portion defined between a second pair of first ribs of the plurality of first ribs and a second number of second ribs of the plurality of second ribs disposed between the second pair of first ribs, wherein the first number of second ribs is different from the second number of second ribs, wherein the first portion does not overlap the second portion.

According to the present teaching, it is possible to improve the uniformity of rigidity of the sheet in the width direction by adjusting the waveform of the sheet by the second rib, and thereby making it possible to improve accuracy of image recording.

BRIEF DESCRIPTION OF THE DRAWINGS

FIG. 5A is a plan view; FIG. 5B is a left side view; FIG. 5C is a front view; FIG. 5D is a right side view;

FIG. 5E is a perspective view; and FIG. 5F is a bottom view.

FIG. 6A is a plan view; FIG. 6B is a left side view; FIG. 6C is a front view; FIG. 6D is a right side view;

FIG. 6E is a perspective view; and FIG. 6F is a bottom view.

FIG. 8A is a cross-sectional view showing only a platen 50; and FIG. 8B is a cross-sectional view showing the platen 50 and the contact members 60, 70.

FIG. 11A is a cross-sectional view of the platen 50 perpendicular to the front-rear direction 8;

FIG. 11B is a vertical cross-sectional view of the platen 50 at a first position; FIG. 11C is a vertical cross-sectional view of the platen 50 at a position between the first position and a second position; and FIG. 11D is a vertical cross-sectional view of the platen 50 at the second position.

DESCRIPTION OF THE PREFERRED EMBODIMENTS

Figure 1:
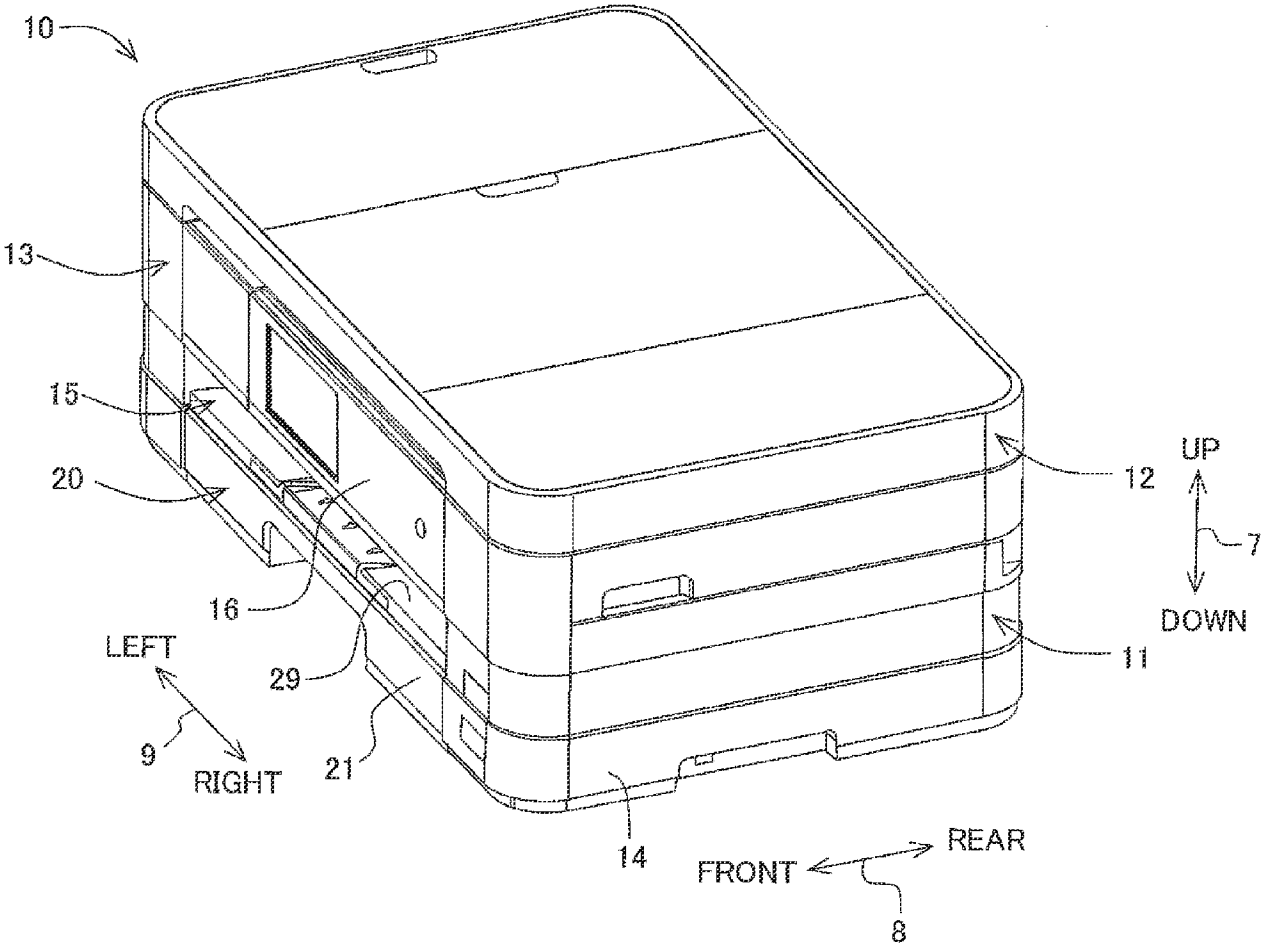
FIG. 1 is a perspective view of an ink-jet recording apparatus 10.

Hereinbelow, an explanation will be made with respect to an embodiment of the present teaching. Noted that the embodiment described below is merely an example of the present teaching; and the embodiment may be changed appropriately within a range without changing the gist or essential characteristics of the present teaching. In the following explanation, as shown in FIG. 1, an up-down direction 7 is defined based on a state in which an ink-jet recording apparatus 10 is installed usably. Further, an operation panel 16 is provided on a side surface of the ink-jet recording apparatus 10; and a front-rear direction 8 is defined assuming that the side surface is the front side (front surface) of the ink-jet recording apparatus 10. A left-right direction 9 is defined assuming that the ink-jet recording apparatus 10 is viewed from the front side.

[Outline of Ink-Jet Recording Apparatus 10]

As shown in FIG. 1, the ink-jet recording apparatus 10 is provided with a printer section 11 which records an image to a sheet 6 (see FIG. 2) including a regular paper sheet, a glossy paper sheet, a postcard, and the like and a scanner section 12 which scans the image recorded on an unillustrated document. The ink-jet recording apparatus 10 is capable of executing printing, scanning, copying, etc. In the ink-jet recording apparatus of the present teaching, any other function other than the printing function is not indispensable. For example, it is not indispensable to provide the scanner section 12 in the ink-jet recording apparatus 10. In the present description, any detailed explanation about the scanner section 12 will be omitted.

[Outline of Printer Section 11]

Figure 2:
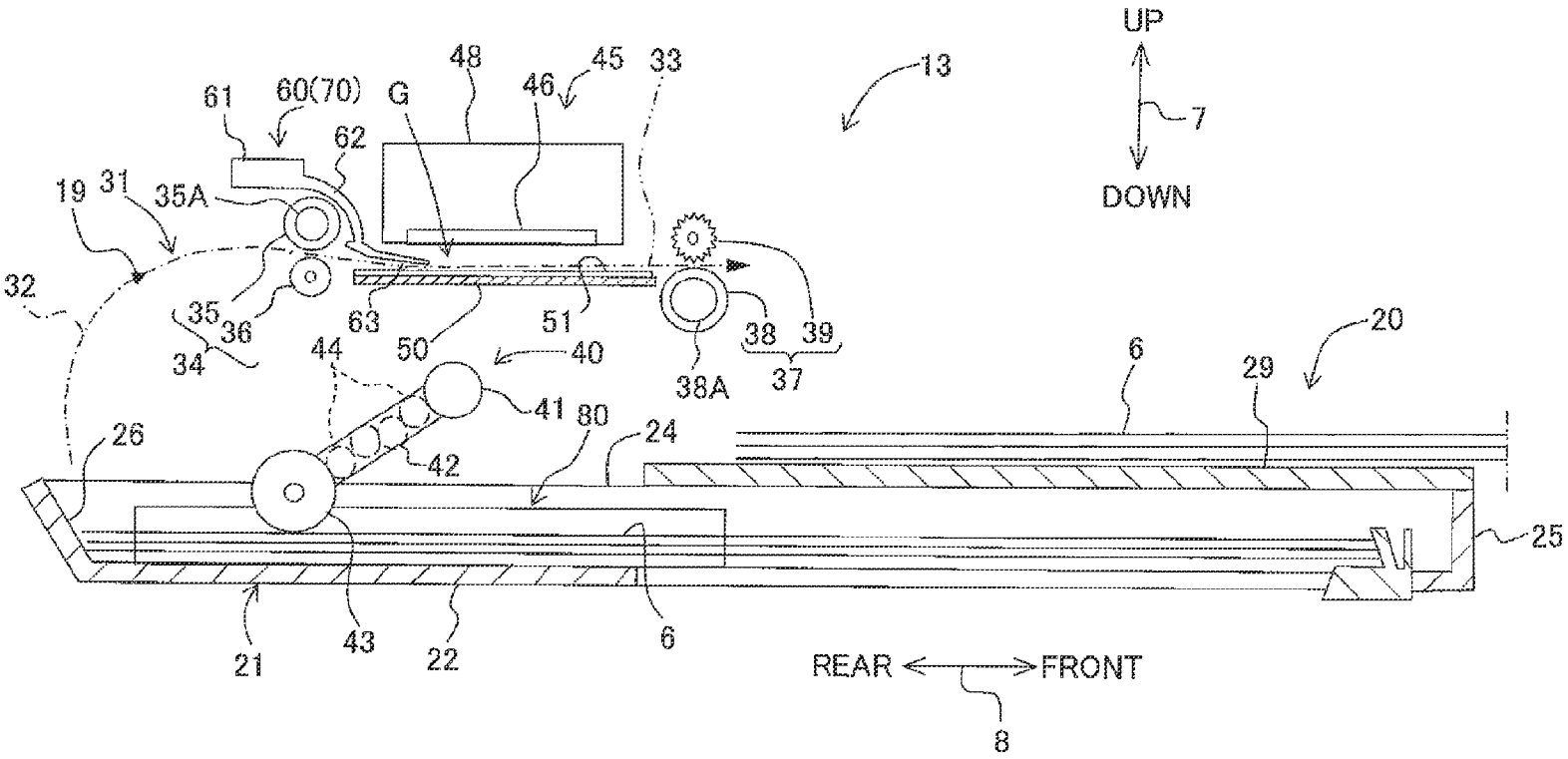
FIG. 2 is a vertical cross-sectional view schematically showing a body 13.

As shown in FIG. 1, the printer section 11 is provided with a body 13 and a paper feed cassette 20 accommodated in a lower portion of the body 13. As shown in FIG. 2, sheets 6 are placed in the paper feed cassette 20. In a casing 14 (FIG. 1) of the body 13, there are provided a feed section 40, a transport path 31, a pair of transport rollers 34, a pair of paper discharge rollers 37, contact members 60, 70, and a recording section 45, those of which are shown in FIG. 2. In the body 13, the sheet 6 is fed to the transport path 31 by the feed section 40; the sheet 6 fed by the feed section 40 is transported by the pair of transport rollers 34; the sheet 6 transported by the pair of transport rollers 34 is held by the contact members 60, 70 to be in a undulant state (form of a wave); and ink droplets are jetted from recording section 45 to the sheet 6 in the undulant state to record the image thereon. The sheet 6 on which the image has been recorded is discharged to a paper discharge tray 29 of the paper feed cassette 20 by the pair of paper discharge rollers 37. Hereinbelow, an explanation will be made about each component of the printer 11.

[Casing 14]

As shown in FIG. 1, the casing 14 includes an insertion opening 15, into which the paper feed cassette 20 is inserted or from which the paper feed cassette 20 is removed, on the front side in the front-rear direction 8. The paper feed cassette 20 is capable of sliding in the front-rear direction 8 from the insertion opening 15.

[Paper Feed Cassette 20]

As shown in FIG. 1, the paper feed cassette 20 is accommodated in the lower portion of the casing 14 and is capable of sliding in the front-rear direction 8. As shown in FIG. 2, the paper feed cassette 20 is provided with a paper feeding tray 21 on which the sheets 6 to be fed to the recording section 45 are retained and the paper discharge tray 29 on which the sheets 6 for which the image has been recorded are discharged.

[Paper Feeding Tray 21]

Figure 3B:
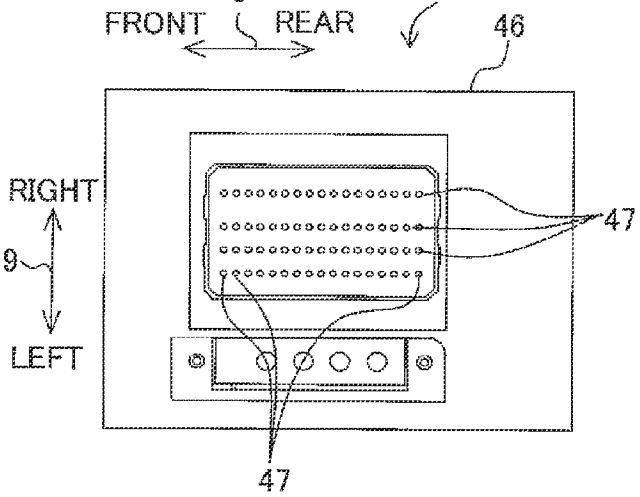
FIG. 3B is a bottom view of a recording head 46.
Figure 3A:
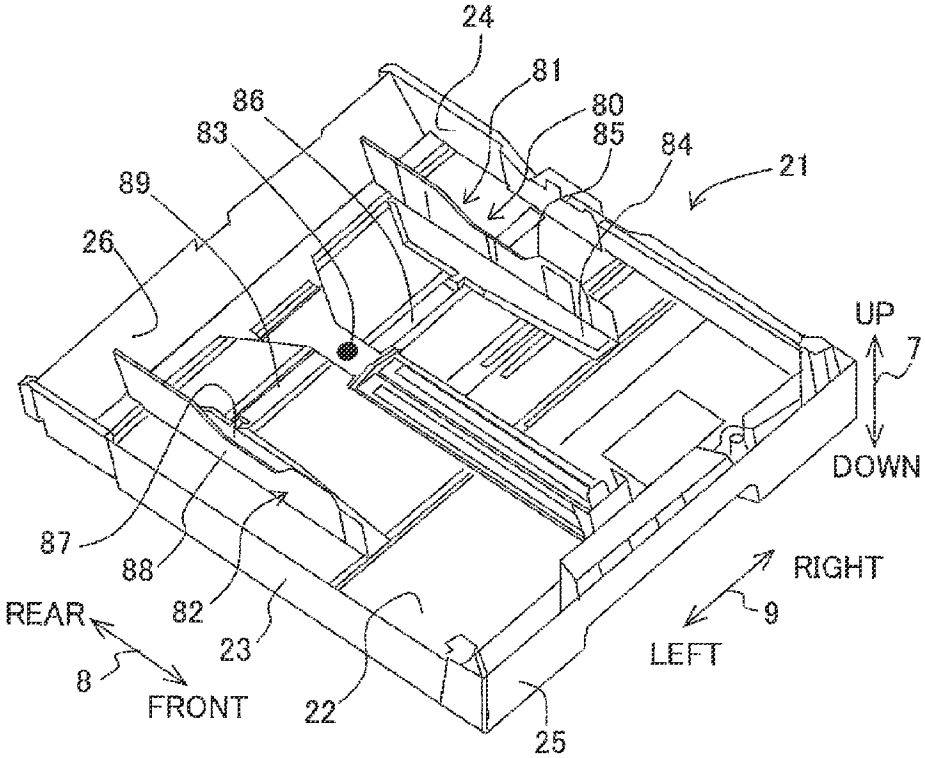
FIG. 3A is a perspective view of a paper feeding tray 21.

As shown in FIG. 3A, the paper feeding tray 21 is provided with a bottom plate 22, a left-side plate 23, a right-side plate 24, a front plate 25, and an inclined plate 26. The left-side plate 23 and the right-side plate 24 are protruded upward from both end portions of the bottom plate 22 in the left-right direction 9. The front plate 25 is protruded upward from the front end portion of the bottom plate 22 in the front-rear direction 8. The paper discharge tray 29 as shown in FIG. 2 is supported by the left-side plate 23, the right-side plate 24, and the front plate 25. The inclined plate 26 extends obliquely upward in a rear direction from a rear end of the bottom plate 22 in the front-rear direction 8. The inclined plate 26 guides the sheet 6 fed by the feed section 40 to the transport path 31 as shown in FIG. 2.

On the bottom plate 22, the sheets 6 in various sizes, such as A4 size, B5 size, legal size, and postcard size, are placed. Thus, a side-guide mechanism 80 as shown in FIG. 3A is provided in the bottom plate 22. Each of the sheets 6 in the various sizes placed on the bottom plate 22 is positioned with respect to the center line of the sheet by the side-guide mechanism 80; and a skew of the sheet 6 is prevented by the side-guide mechanism 80. The positioning with respect to the center line of the sheet means a positioning in which the center of the sheet 6 in the left-right direction 9 is coincident with the center of the bottom plate 22 in the left-right direction 9. Noted that, in the present teaching, the positioning of the sheet is not limited to the positioning with respect to the center line of the sheet. The positioning may be performed by any appropriate method as needed. For example, instead of the positioning with respect to the center line of the sheet, the positioning may be performed so that one end of the sheet 6 in the left-right direction is coincident with one end portion of the bottom plate 22 in the left-right direction.

[Side-Guide Mechanism 80]

As shown in FIG. 3A, the side-guide mechanism 80 is provided with a pair of left and right guide members 81, 82 which is slidably supported in the left-right direction 9 by the bottom plate 22 and a pinion gear 83 which moves the pair of guide members 81, 82 in cooperation with each other. The pinion gear 83 is disposed at the center portion of the bottom plate 22 in the left-right direction 9, such that a central axis line of the pinion gear 83 is along the up-down direction 7.

The guide member 81 is arranged at a right portion of the bottom plate 22 in the left-right direction 9. The guide member 81 is provided with a support plate 84 placed on the bottom plate 22, a side plate 85 which protrudes upward from a right end portion of the support plate 84 in the left-right direction 9, and a rack gear 86 which extends leftward in the left-right direction 9 from the support plate 84. The rack gear 86 is engaged with the pinion gear 83 on the front side of the pinion gear 83 in the front-rear direction 8.

The guide member 82 is arranged at a left portion of the bottom plate 22 in the left-right direction 9. The guide member 82 is provided with a support plate 87, a side plate 88, and a rack gear 89. The guide member 82 is formed to be substantially bilaterally symmetric with the guide member 81. The rack gear 89 of the guide member 82 is engaged with the pinion gear 83 on the rear side thereof in the front-rear direction 8.

After the sheet 6 is placed on the bottom plate 22 by a user, the guide member 81 is slid leftward in the left-right direction 9. Then, the support plate 84 is hidden under a right end portion of the sheet 6 in the left-right direction 9 and the side plate 85 makes contact with the right end of the sheet 6. In a case that the guide member 81 is slid leftward in the left-right direction 9, the pinion gear 83 is rotated and the guide member 82 is slid rightward in the left-right direction 9. Then, the support plate 87 is hidden under a left end portion of the sheet 6 in the left-right direction 9 and the side plate 88 makes contact with the left end of the sheet 6. Accordingly, each of the sheets 6 in the various sizes placed on the bottom plate 22 is positioned so that the positioning with respect to the center line of each of the sheets is performed by the side-guide mechanism 80. Further, in a case that the sheet 6 is fed rearward in the front-rear direction 8 by the feed section 40 as will be described later on, both ends of the sheet 6 in the left-right direction 9 respectively make contact with the side plates 85, 88, and thereby the skew of the sheet 6 is suppressed.

[Feed Section 40]

As shown in FIG. 2, the feed section 40 is provided with a supporting shaft 41 which is rotatably supported by an unillustrated frame, an arm 42 of which one end portion is rotatably supported by the supporting shaft 41 and which extends obliquely downward in the rear direction from the supporting shaft 41, and a feed roller 43 which is rotatably supported by the other end portion of the arm 42. In the arm 42, there are provided a plurality of gears 44 to transmit rotation of the supporting shaft 41 to the feed roller 43.

In a case that the supporting shaft 41 is rotated by an unillustrated drive motor, the arm 42 is rotated integrally with the supporting shaft 41 by a frictional force between the supporting shaft 41 and the arm 42, and thereby the feed roller 43 makes contact with the sheet 6 on the paper feeding tray 21. Then, the rotation of the arm 42 is restrained. The sheet 6 is fed to the transport path 31 by the feed roller 43 which is rotated by the supporting shaft 41 via the gears 44.

[Transport Path 31]

As shown in FIG. 2, the transport path 31 is a path through which the sheet 6 is transported. The transport path 31 is defined by a plurality of unillustrated guide members and the platen 50. The transport path 31 has a curved path 32 depicted by alternate long and short dash lines and a straight path 33 depicted by two-dot lines. The curved path 32 extends upward with an upper end of the inclined plate 26 of the paper feeding tray 21 as a base end, and then curves to extend frontward in the front-rear direction 8. The straight path 33 extends frontward in a form of straight line from an end of the curved path 32. A lower surface of the straight path 33 is defined by the platen 50. The image is recorded on the sheet 6 on the platen 50. An explanation will be made below in detail about the platen 50.

[Guide Rails 92, 93]

Figure 4:
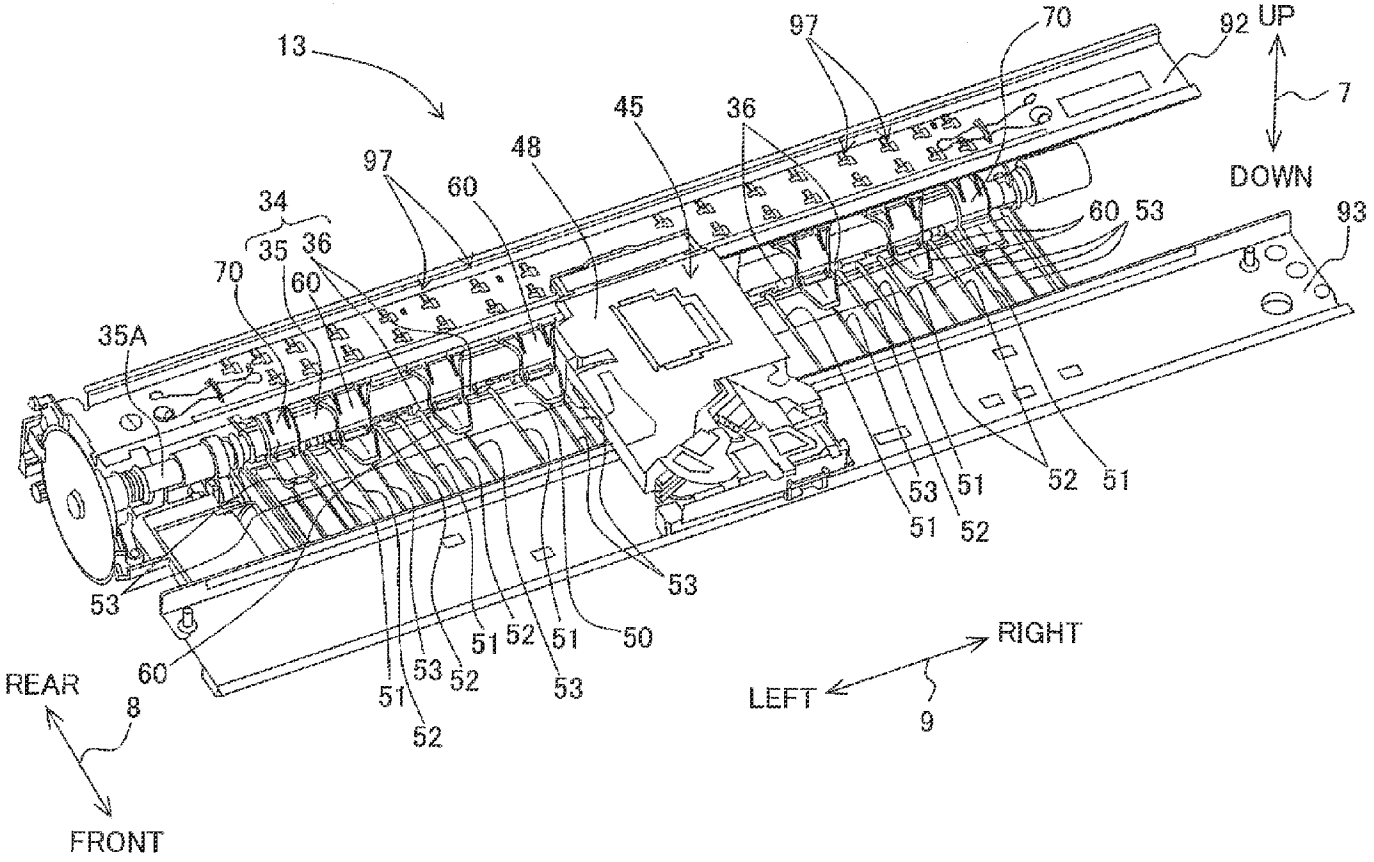
FIG. 4 is a perspective view of a part of the body 13.
Figure 5A:
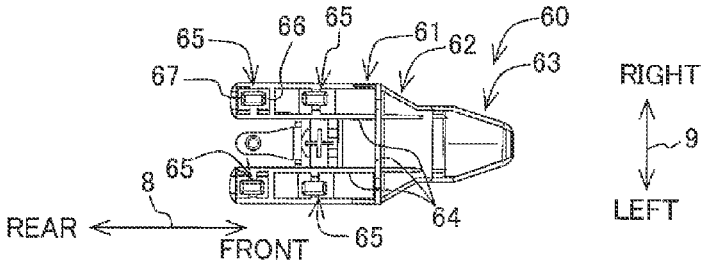
FIGS. 5A to 5F are views each showing an contact member 60, where
Figure 5B:
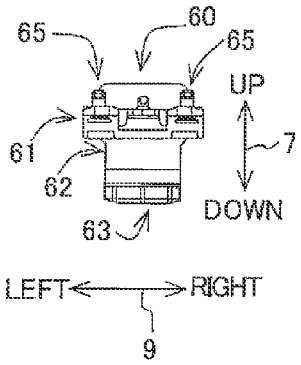
Figure 5C:
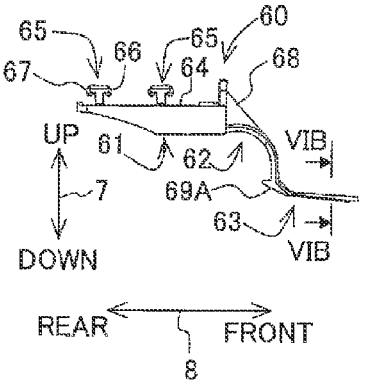
Figure 5D:
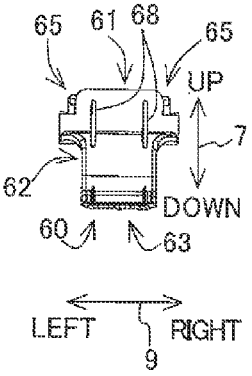
Figure 5E:
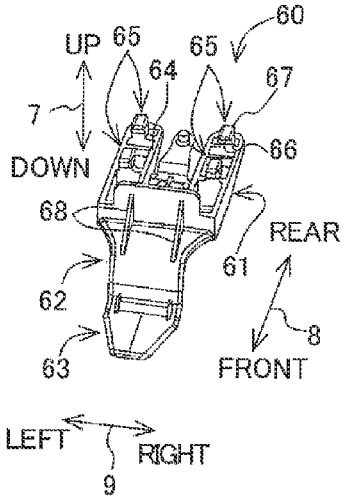
Figure 5F:
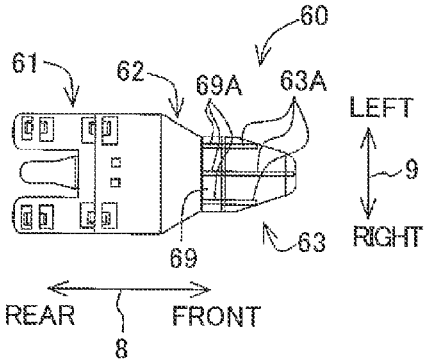
Figure 6A:
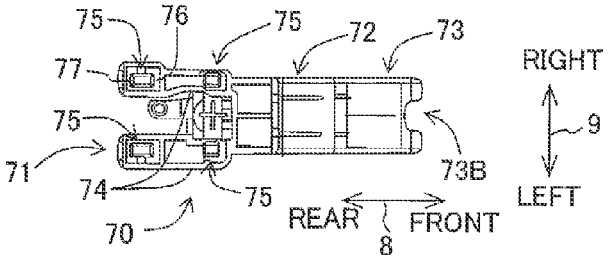
FIGS. 6A to 6F are views each showing an contact member 70, where
Figure 6B:
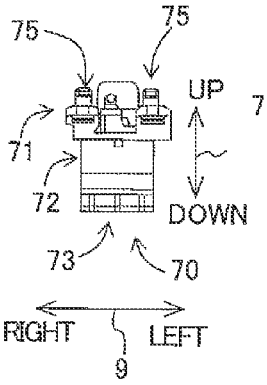
Figure 6C:
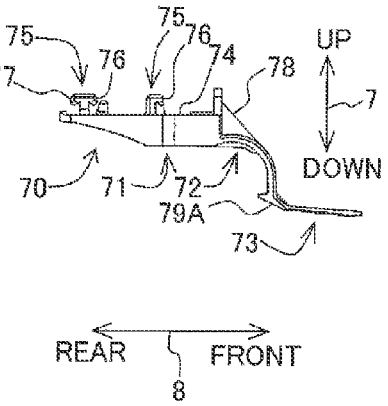
Figure 6D:
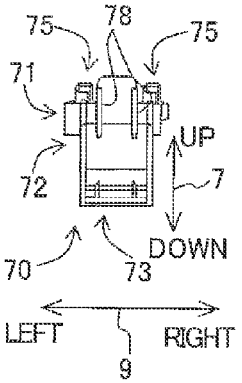
Figure 6E:
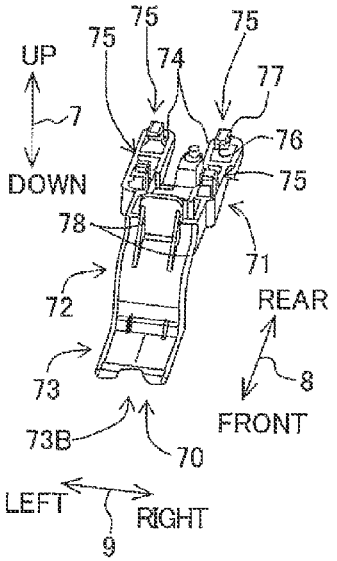
Figure 6F:
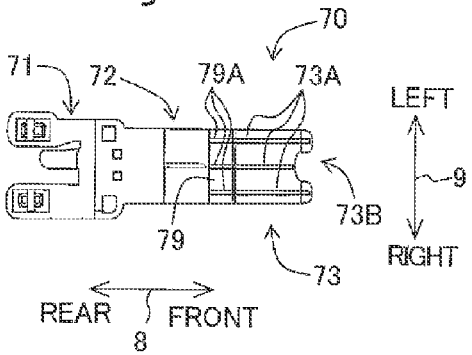

As shown in FIG. 4, a pair of front and rear guide rails 92, 93 is arranged on the upper side of the platen 50. The recording section 45 is provided to span between the pair of front and rear guide rails 92, 93. Each of the guide rails 92, 93 is formed of a steel plate extending in the left-right direction 9. The guide rails 92, 93 are disposed to be separated from each other in the front-rear direction 8. Both end portions of the guide rails 92, 93 in the left-right direction 9 are supported by the unillustrated frame. The guide rails 92, 93 support the recording section 45, which is provided to span therebetween, so that the recording section 45 is reciprocatively movable in the left-right direction 9.

Figure 7A:
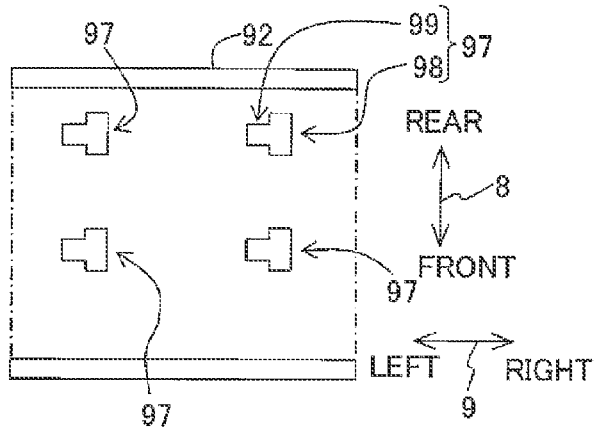
FIG. 7A is a plan view showing a part of a guide rail 92.
Figure 7B:
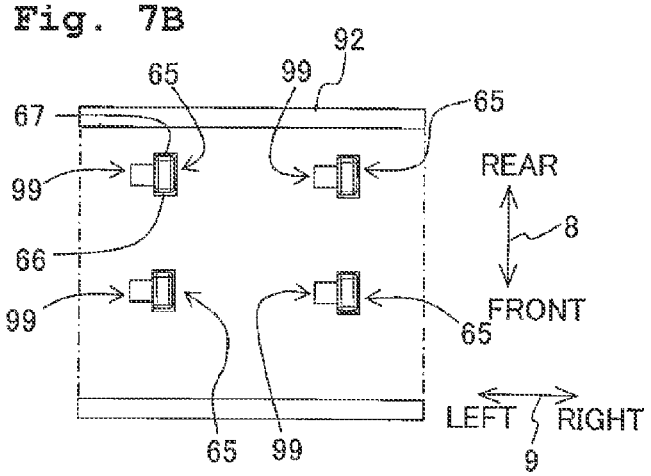
FIG. 7B is a view showing a state in which insertion projections 65 are inserted into first holes 98.
Figure 7C:
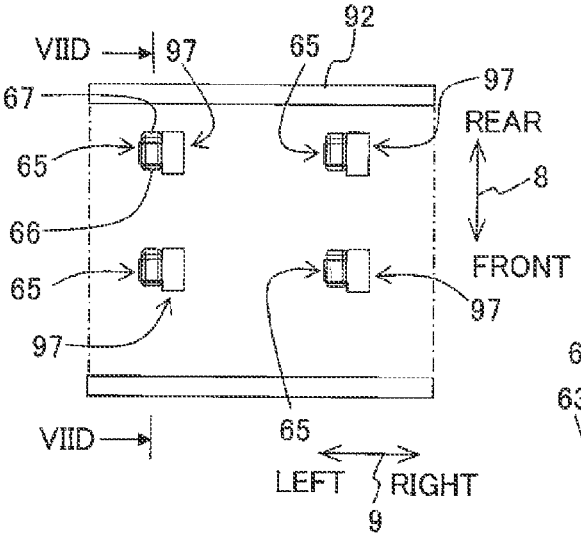
FIG. 7C is a view showing a state in which the contact member 60 is attached to the guiderail 92.
Figure 7D:
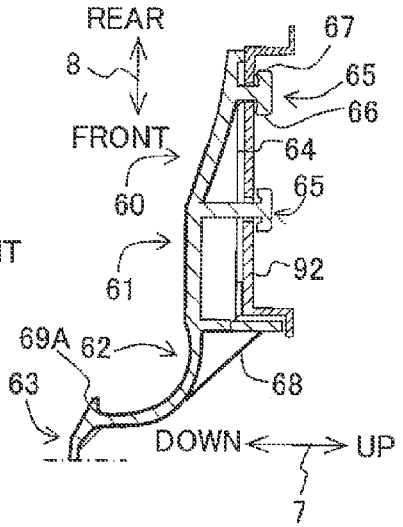
FIG. 7D is a cross-sectional view taken along VIID-VIID in FIG. 7C.

As shown in FIGS. 4 to 6, a plurality of insertion holes 97, into which the insertion projections 65, 75 of the contact members 60, 70 as will be described later on are inserted, are provided in the guide rail 92. As shown in FIG. 7A, there are formed, in each insertion hole 97, a first hole 98 extending in the front-read direction 8 and a second hole 99 extending leftward in the left-right direction 9 from a center portion of the first hole 98 in the front-read direction 8. Each of the insertion projections 65 (75) is inserted into one of the first holes 98 from the lower side of the guide rail 92, then is moved leftward in the left-right direction 9 as shown in FIG. 7B; and is engaged with (fitted into) one of the second holes 99 as shown in FIGS. 7C and 7D. Details will be described later.

[Recording Section 45]

As shown in FIG. 2, the recording section 45 is provided with a carriage 48 and a recording head 46 carried on the carriage 48. The recording section 45 is arranged on the upper side of the platen 50. A gap G is formed between the recording section 45 and the platen 50.

As shown in FIG. 4, the carriage 48 is provided to span between the guide rails 92, 93 and is supported by the guide rails 92, 93 to be reciprocatively movable in the left-right direction 9. The carriage 48 is fixed to an unillustrated belt. The belt is provided to the guide rail 93 to be capable of performing rounding motion. The belt performs the rounding motion by the unillustrated drive motor to reciprocate the carriage 48 in the left-right direction 9.

As shown in FIG. 2, the recording head 46 is carried on the carriage 48 and is positioned on the upper side of the platen 50. As shown in FIG. 3B, the recording head 46 includes a plurality of nozzles 47, from which the ink droplets are jetted, on a lower surface thereof. The recording head 46 records the image on the sheet 6 by jetting the ink droplets from the nozzles 47 to the sheet 6 on the platen 50.

[A Pair of Transport Rollers 34]

As shown in FIG. 2, the pair of transport rollers 34 is disposed at a position on an upstream side (rear side in the front-rear direction 8) of the platen 50 in the transport direction 19 and on a lower side of the guide rail 92 shown in FIG. 4 so that a nip position of the pair of transport rollers 34 is close to the platen 50. The pair of transport rollers 34 is provided with a transport roller 35 and a driven roller 36 arranged on a lower side of the transport roller 35. The transport roller 35 is provided to a rotation shaft 35A extending in the left-right direction 9 (direction perpendicular to the sheet surface of FIG. 2). The transport roller 35 is rotated integrally with the rotation shaft 35A. Both end portions of the rotation shaft 35A in the left-right direction 9 are rotatably supported by the unillustrated frame.

Figure 10A:
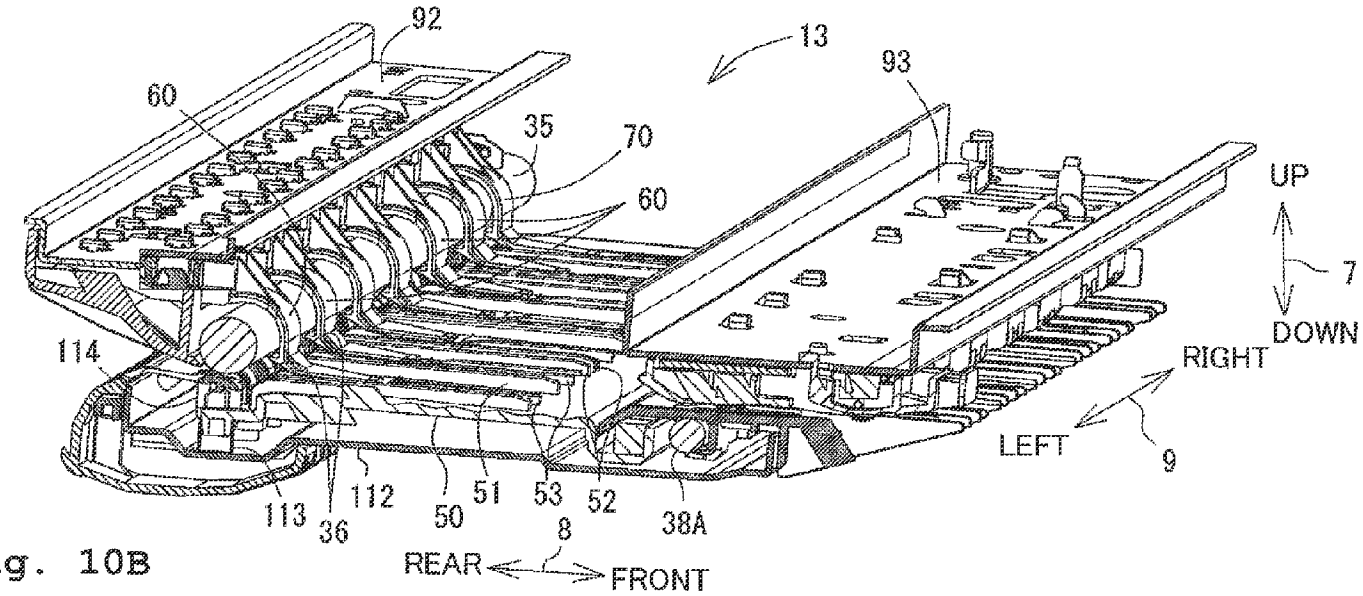
FIG. 10A is a perspective view in which a part of the body 13 is broken.

The driven roller 36 is rotatably supported by a holder 114 as shown in FIG. 10A. The holder 114 is urged or biased upward by an unillustrated elastic member. As shown in FIG. 2, the driven roller 36 is brought in contact under pressure with the transport roller 35 disposed on the upper side by the elastic member. In a case that the rotation shaft 35A is rotated by the unillustrated drive motor, the pair of transport rollers 34 nips the sheet 6 to transport the sheet 6 in the transport direction 19.

[A Pair of Paper Discharge Rollers 37]

As shown in FIG. 2, the pair of paper discharge rollers 37 is disposed at a position on a downstream side (front side in the front-rear direction 8) of the platen 50 in the transport direction 19 and on a lower side of the guide rail 93. The pair of paper discharge rollers 37 is provided with a plurality of paper discharge rollers 38 and a plurality of spurs 39 disposed on an upper side of the paper discharge rollers 38. The paper discharge rollers 38 are provided to a rotation shaft 38A extending in the left-right direction 9 (direction perpendicular to the sheet surface of FIG. 2). The paper discharge rollers 38 are rotated integrally with the rotation shaft 38A. Both end portions of the rotation shaft 38A in the left-right direction 9 are rotatably supported by the unillustrated frame.

The spurs 39 are rotatably supported by an unillustrated elastic shaft. Both end portions of the elastic shaft in a shaft direction is supported by an unillustrated holding member held by the guide rail 93. The spurs 39 are brought in contact under pressure with the paper discharge rollers 38 by the elastic shaft in a bent state. In a case that the rotation shaft 38A is rotated by the unillustrated drive motor, the pair of paper discharge rollers 37 nips the sheet 6, transports the sheet 6 in the transport direction 19, and discharges the sheet 6 on the paper discharge tray 29. Each of the pair of transport rollers 34 and the pair of paper discharge rollers 37 is an example of a transport section of the present teaching.

[Contact Member 60]

The contact members 60, 70 as shown in FIG. 2 are members, each of which makes the transported sheet 6 be in the undulant state in cooperation with each of the first ribs 51 of the platen 50. As will be described later, the contact members 60, 70 and the first ribs 51 make the sheet 6 be in the undulant state in which portions forced downward by the contact members 60 are "valley" shaped and portions supported by the first ribs 51 are "peak" shaped.

As will be described later, the first ribs 51 are disposed to be bilaterally symmetric with reference to the center of the platen 50 in the left-right direction 9. Thus, the platen 50 is shown in FIG. 8 so that a left portion of the platen 50 in the left-right direction 9 is omitted. A left end of the platen 50 in FIG. 8 corresponds to the center of the platen 50. As shown in FIG. 8, one contact member 60 (60A) is arranged on the upper side of the platen 50 at the center in the left-right direction 9. Three contact members 60 (60B, 60C, 60D) are arranged on the right side of the contact member 60A, which is disposed at the center, in the left-right direction 9 (an example of a width direction of the present teaching) while being away from each other by a distance D (D10, D11, D12). Also on the left side of the contact member 60A in the left-right direction 9, three contact members 60 are arranged while being away from each other by the distance D (D10, D11, D12).

The distances D10, D11, D12 have the same distance D. The reason thereof is that each distance between peaks of the waveform is made to be uniform (a cycle of the wave is made to be uniform). The recording head 46 jets the ink droplets taking the distance between the recording head 46 and the sheet 6 which changes in a constant period into consideration, and thereby improving accuracy of the image recording. By changing the distance between the recording head 46 and the sheet 6 in the constant period, it is possible to control the recording head 46 more easily.

Hereinbelow, an explanation will be made in detail about the contact member 60 with reference to FIGS. 5 and 7. Noted that the up-down direction 7, the front-rear direction 8, and the left-right direction 9 as shown in FIGS. 5 and 7 are directions in a state that the contact member 60 is attached to the guide rail 92.

As shown in FIGS. 5A to 5F, the contact member 60 is provided with an attaching portion 61 through which the contact member 60 is attached to the guide rail 92, an contact portion 63 which holds the sheet 6, and a curved portion 62 by which the attaching portion 61 and the contact portion 63 are connected. The contact member 60 is formed of a resin material having elasticity so that an elastic deformation of the contact portion 63 is possible. The elastic deformation of the contact portion 63 will be described later on.

A plurality of reinforcing ribs 64 and four insertion projections 65 inserted into the insertion holes 97 (FIG. 7A) of the guide rail 92 are protruded upward from the upper surface of the attaching portion 61. The four insertion projections 65 are disposed so that two insertion projections 65 are aligned in the front-rear direction 8 and the left-right direction 9, respectively. The reason why the four insertion projections 65 are provided is that the attaching portion 61 is reliably supported at four points.

A pair of front and rear claws 66, 67, which is snagged on the upper surface of the guide rail 92, is provided at a front end portion (upper end portion) of the projection of the insertion projection 65. The claw 66 is protruded from frontward in the front-rear direction 8 from the front end portion (upper end portion) of the projection of the insertion projection 65. The claw 67 is protruded rearward in the front-rear direction 8 from the upper end portion of the insertion projection 65.

The contact member 60 is attached to the guide rail 92 as follows. At first, as shown in FIG. 7B, each of the insertion projections 65 is inserted into one of the first holes 98 from the lower surface side of the guide rail 92. Then, the contact member 60 is slid leftward in the left-right direction 9; and each of the insertion projections 65 is fitted into one of the second holes 99 as shown in FIGS. 7C and 7D. The attaching portion 61 is attached to the guide rail 92 as follows. That is, the insertion projections 65 make contact with a wall surface defining the second holes 99 in the front-rear direction 8 and the claws 66, 67 are snagged on the upper surface of the guide rail 92.

As shown in FIGS. 5A to 5F, the curved portion 62 is curved to be arch-shaped along a circumferential surface of the transport roller 35 as shown in FIG. 2. Accordingly, contact between the curved portion 62 and the transport roller 35 is avoided. The curved portion 62 is reinforced with reinforcing rib(s) 68 so that the curved portion 62 is prevented from bending A guide surface 69 which guides a downstream end of the transported sheet 6 in the transport direction 19 (hereinbelow, referred to simply as the front end of the sheet 6) to the contact portion 63 is provided at a lower end of the curved portion 62. The guide surface 69 will be specifically explained below. The guide surface 69 of the curved portion 62 is formed in an inclined surface extending obliquely downward in the front direction from an obliquely upper position in the front direction of the nip position of the pair of transport rollers 34 as shown in FIG. 2. Three guide ribs 69A extending in a direction in which the guide surface 69 extends (obliquely downward in the front direction) protrude downward from the guide surface 69. The respective guide ribs 69A are provided at both end portions and the center portion of the guide surface 69 in the left-right direction 9. The front end of the sheet 6 transported by the pair of transport rollers 34 is brought in contact with the front ends (lower ends) of the projections of the guide ribs 69A and then is guided to the contact portion 63.

As shown in FIGS. 5A to 5F, the contact portion 63 has a plate shape extending obliquely downward in the front direction from a front surface of a lower end portion of the curved portion 62 in the front-rear direction 8. The contact portion 63 is slightly inclined with respect to a horizontal surface so that the contact portion 63 is closer to the upper surface of the platen 50 as shown in FIG. 2 toward the front direction. The front end of the contact portion 63 in the front-rear direction 8 is positioned on a rear side of the nozzles 47 (see FIG. 3B) of the recording head 46 in the front-rear direction 8; and is close to the nozzles 47. The plurality of contact portions 60 are attached to the guide rail 92 so that the contact portions 63 are placed at the same position in the up-down direction 7 and the front-rear direction 8.

The reason why the contact portion 63 is inclined is that the front end of the sheet 6 is guided to the front end of the contact portion 63 in the front-rear direction 8. Further, the reason why the contact portion 63 is plate shaped is that the contact portion 63 is disposed at the gap G having a short distance in the up-down direction 7 as shown in FIG. 2 and strength of the contact portion 63 is secured. The reason why the front end of the contact portion 63 in the front-rear direction 8 is close to the nozzles 47 is that the sheet 6 is held at a position close to the nozzles 47 and the accuracy of the image recording is improved.

The contact portion 63 has a shape being narrowed toward the front direction in the front-rear direction 8 in which both ends of the contact portion 63 in the left-right direction 9 are inclined to be close to each other, in order that the contact portion 63 can bend in the up-down direction 7 more easily. By forming the contact portion 63 to have the shape being narrowed toward the front direction, the front end portion of the contact portion 63 is bent when the transported sheet 6 is allowed to be in the undulant state. The front end portion of the contact portion 63 is allowed to be bent in order to adjust the waveform. Details will be described later. Further, the front end portion of the contact portion 63 is bent in a case that a slightly thick sheet 6 is transported, and thereby jam of the thick sheet 6 between the contact portion 63 and the platen 50 is suppressed.

Three abutting ribs 63A extending in a direction in which the contact portion 63 extends (obliquely downward in the front direction) protrude downward from the lower surface of the contact portion 63. The respective abutting ribs 63A are provided at both end portions and the center portion of the contact portion 63 in the left-right direction 9. Each of the abutting rib 63A is connected to one of the guide ribs 69A of the guide surface 69 of the curved portion 62. Each of the abutting ribs 63A makes contact with the upper surface of the transported sheet 6 to hold the sheet 6 from the upper side. By providing the abutting ribs 63A, a contact area between each of contact members 60 and the sheet 6 is reduced, and thereby decreasing transport resistance of the sheet 6. As a result, the accuracy of the image recording is improved.

[Contact Member 70]

As shown FIG. 4, the contact members 70 are disposed on the upper side of the platen 50 at both end portions in the left-right direction 9. Therefore, the contact member 70 has a shape which is slightly different from that of the contact member 60. Hereinbelow, an explanation will be made in detail about the contact member 70 with reference to FIGS. 6A to 6F. Noted that, in FIGS. 6A to 6F, the up-down direction 7, the front-rear direction 8, and the left-right direction 9 are shown as directions in which the contact members 70 are attached to the guide rail 92.

The contact member 70 is provided with an attaching portion 71, a curved portion 72, and an contact portion 73. Similar to the contact member 60, reinforcing ribs 74 and insertion projections 75 are provided in the attaching portion 71. Similar to the attaching portion 61 of the contact member 60, the attaching portion 71 is attached to the guiderail 92 by four insertion projections 75, claws 76, 77 provided in each of the insertion projections 75, and the reinforcing ribs 74.

The curved portion 72 includes reinforcing rib(s) 78, a guide surface 79, and a guide rib 79A and is formed to have a shape which is substantially same as the curved portion 62 of the contact member 60.

The contact portion 73 has a rectangular plate shape to be slightly inclined with respect to the horizontal surface so that the front end of the contact portion 73 in the front-rear direction 8 is positioned below or under the rear end thereof. In the up-down direction 7 and the front-rear direction 8, the front end (lower end) of the contact portion 73 in the front-rear direction 8 has the same position as the front end (lower end) of the contact portion 63 in the front-rear direction 8.

Each of the contact members 70 is disposed at a position at which the left end or the light end of the sheet 6 (for example, A4 size, legal size) in the left-right direction 9 is placed between the two abutting ribs 73A. Thus, in some cases, the sheet 6 makes contact only with the abutting rib 73A disposed on one side in the left-right direction 9. Assuming that the contact portion 73 has the shape being narrowed toward the front direction, like the contact portion 63, the contact portion 73 can not hold the sheet 6 in the vicinity of the nozzles 47. Therefore, the contact portion 73 does not have the shape being narrowed toward the front direction and has the rectangular plate shape. The contact members 70 hold the sheet 6 in the vicinity of the nozzles 47 by the abutting ribs 73A at the inside of the both ends of the sheet 6 in the left-right direction 9. Noted that a notch portion 73B having a shape formed to be cut from the front end is provided in the front end portion of the contact portion 73 in the front-rear direction 8 at the center portion in the left-right direction 9. By providing the notch portion 73B, the front end of the abutting rib 73A in the front-rear direction 8, which is provided at the center portion of the contact portions 73 arranged in the left-right direction 9, is positioned in a rear direction of the front end of each of the abutting ribs 73A disposed on both ends of the abutting rib 73A provided at the center portion.

[Platen 50]

As shown in FIG. 2, the platen 50 is disposed on the upper side of the paper feed cassette 20 and is positioned on the lower side of the recording head 46. The platen 50 has a plate-shaped profile having a thickness in the up-down direction 7. As shown in FIG. 4, the plurality of first ribs 51, a plurality of second ribs 52, and a plurality of convex ribs 53 (an example of a third rib of the present teaching), those of which extend in the transport direction 19 as shown in FIG. 2, are protruded upward from the upper surface of the platen 50.

Figure 8A:
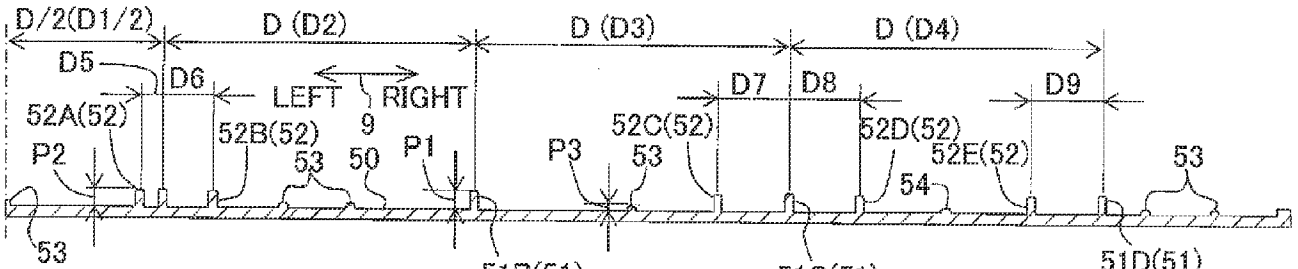
FIGS. 8A and 8B are cross-sectional views each being perpendicular to a front-rear direction 8, where
Figure 9A:
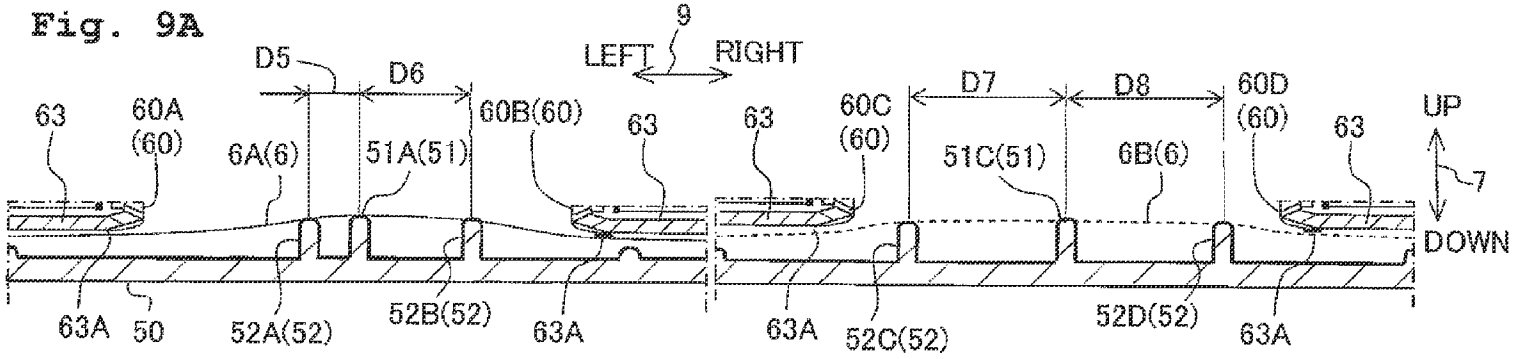
FIG. 9A is a view showing a state in which a sheet 6 is made to be in a undulant state.

As shown in FIG. 9A, the first ribs 51 are ribs, each of which supports the transported sheet 6 to form a portion which is the "peak" in the undulant state. Each of the first ribs 51 is arranged at a position which is located midway, in the left-right direction 9, between two contact members 60 adjacent to each other. In particular, as shown in FIG. 8A, a first rib 51A, which is closest to the center of the platen 50 in the left-right direction 9, is arranged to be separated from said center by a distance D/1;2. A first rib 51B disposed adjacently on the right side of the first rib 51A is arranged to be separated from the first rib 51A by a distance D2. A first rib 51C disposed adjacently on the right side of the first rib 51B is arranged to be separated from the first rib 51B by a distance D3. A first rib 51D disposed adjacently on the right side of the first rib 51C is arranged to be separated from the first rib 51C by a distance D4. As described above, two contact members 60, which are adjacent to each other in the left-right direction 9, are away from each other by the distance D and the first ribs 51A to 51D are interposed midway between the contact members 60. Thus, all of the distances D1, D2, D3, D4 have the same distance D. Each of the first ribs 51 extends in the transport direction 19 to be provided across a substantially entire range of the platen 50 in the front-rear direction 8. By providing each of the first ribs 51 as described above, each distance between the top of each peak and the top of each valley of the sheet 6 in the undulant state becomes uniform, and thereby making it possible to control the recording head 51 more easily.

As shown in FIG. 8A, a projection amount P1, of each of the first ribs 51, from the upper surface of the platen 50 is set so that an upper end of each of the first ribs 51 is positioned over or above a lower end (front end in the front-rear direction 8) of each of the abutting ribs 63A. By doing so, the transported sheet 6 is allowed to be in the undulant state in which portions supported by the first ribs 51 are "peak" shaped and portions forced downward by the contact portion 63 are "valley" shaped. The plurality of first ribs 51A to 51D have the same projection amount P1. The reason thereof is that height position of the top of each of the peaks in the undulant state is made to be uniform.

By the way, the center portion of the sheet 6 has difficulty to be in the undulant state as compared with the end portions thereof in the left-right direction 9. Thus, it is difficult that rigidity of the sheet 6 in the left-right direction 9 is made to be uniform only by the first ribs 51 and the contact members 60, 70.

The second ribs 52 as shown in FIG. 8 are ribs as follows. That is, in a case that the sheet 6 is made to be in the undulant state, each of the second ribs 52 makes contact with a part of the sheet 6; makes a radius of curvature of each wave of the waveform on a side closer to the center portion of the sheet 6 in the left-right direction 9 smaller than a radius of curvature of each wave of the waveform on a side away from said center portion; and improves the uniformity of rigidity of the sheet 6 in the left-right direction 9. Hereinbelow, an explanation will be made assuming that the plurality of second ribs 52 are referred to as the second ribs 52A, 52B, 52C, 52D, 52E, in that order, from the center of the platen 50 in the left-right direction 9 to the right side.

The second ribs 52A to 52E are provided to have the same projection amount P2 from the upper surface of the platen 50. The second rib 52A is arranged between the contact member 60A and the first rib 51A. The second rib 52B is arranged between the first rib 51A and the contact member 60B. The second rib 52C is arranged between the contact member 60C and the first rib 51C. The second rib 52D is arranged between the first rib 51C and the contact member 60D. The second rib 52E is arranged between the contact member 60D and the first rib 51D.

A distance D5 between the second rib 52A and the first rib 51A is made to be shorter than a distance D6 between the first rib 51A and the second rib 52B. The distance D6 is made to be shorter than a distance D7 between the first rib 51C and the second rib 52C. The distance D7 has the same distance as a distance D8 between the first rib 51C and the second rib 52D. The distance D8 has the same distance as a distance D9 between the first rib 51D and the second rib 52E.

The projection amount P2 of each of the second ribs 52 is set so that each of the second ribs 52 can support the sheet 6. In particular, the projection amount P2 is determined so that the front end (upper end) of the projection of each of the second ribs 52 is positioned over or above the lower end of each of the contact portions 63 and below the front end (upper end) of the projection of each of the first ribs 51. And further, the projection amount P2 is determined so that the upper end of each of the second ribs 52 is positioned on the upper side of an imaginary line L. The imaginary line L is a line which connects the upper end of one of the first ribs 51 closest to one of the second ribs 52 with the lower end of one of the contact portions 63 closest to said one of the second ribs 52. For example, as shown in an enlarged view in alternate long and short dash lines of FIG. 8B, the upper end of the second rib 52A is positioned on the upper side of the imaginary line L which connects the lower end of the abutting rib 63A of the contact member 60A at the center in the left-right direction 9 with the upper end of the first rib 51A. Further, as shown in an enlarged view in two-dot lines of FIG. 8B, the upper end of the second rib 52D is positioned on the upper side of the imaginary line L which connects the lower end of the abutting rib 63A of the contact member 60D at the center in the left-right direction 9 with the upper end of the first rib 51C. The reason why the projection amount P2 is set so that the upper end of each of the second ribs 52 is positioned below the upper end of each of the first ribs 51 is that a portion held by each of the second rib 52 is prevented from becoming the top portion of the peak in the undulant state.

Figure 9B:
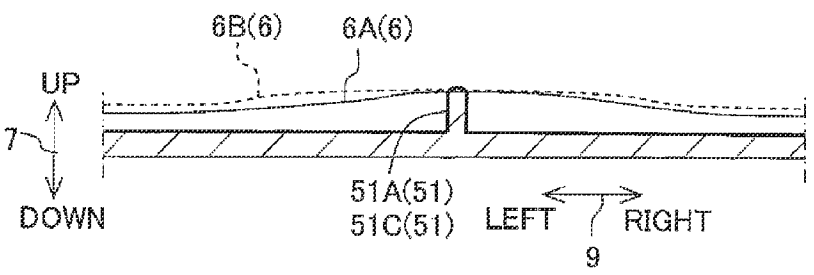
FIG. 9B is a view showing a state in which a part 6A of the sheet 6 and a part 6B of the sheet 6 in FIG. 6A are overlapped with each other.

By providing each of the second ribs 52 as described above, the radius of curvature of each wave of the waveform on the side closer to the center portion of the sheet 6 in the left-right direction 9 is smaller than the radius of curvature of each wave of the waveform on the side away from said center portion. An explanation will be made in detail with reference to FIG. 9. In FIG. 9A, there are shown a part 6A of the sheet 6 supported by the first rib 51A at the center portion of the platen 50 in the left-right direction 9 and a part 6B of the sheet 6 supported by the first rib 51C at the right end portion. FIG. 9B is a view showing a state in which the part 6A of the sheet 6 and the part 6B of the sheet 6 are overlapped with each other.

The transported sheet 6 is supported by the first ribs 51 and the second ribs 52 and is pushed downward by the contact portions 63. The distances D5, D6 between the first rib 51A and the second ribs 52A, 52B provided on both sides of the first rib 51A are shorter than the distances D7, D8 between the first rib 51C and the second ribs 52C, 52D provided on both sides of the first rib 51C. Thus, as shown in FIG. 9B, the radius of curvature of the peak portion of the wave in the part 6A of the sheet 6 is smaller than the radius of curvature of the peak portion of the wave in the part 6B of the sheet 6.

According to relation of length among the distances D5 to D8, the distance between the second rib 52C and the contact member 60C in the left-right direction 9 and the distance between the second rib 52D and the contact member 60D are shorter than the distance between the second rib 52A and the contact member 60A. That is, the side closer to the center of the platen 50 in the left-right direction 9 has a longer distance between each of the second ribs 52 and the top portion of each of the valleys in the left-right direction 9 than the side away from said center portion. Therefore, bending of the contact portion 63 of the contact member 60A on the side closer to the center of the platen 50 is smaller than bending of the contact portions 63 of the contact members 60D, 60E on the side away from said center. Then, the radius of curvature of the valley portion of the wave in the part 6A of the sheet 6 is smaller than the radius of curvature of the valley portion of the wave in the part 6B of the sheet 6. Thus, in both of the peaks and the valleys, the radius of curvature of each wave of the waveform in the part 6A of the sheet 6 is smaller than the radius of curvature of each wave of the waveform in the part 6B of the sheet 6. As a result, the uniformity of rigidity of the sheet 6 in the left-right direction 9 is improved. Accordingly, the waveform is less likely to be changed (lost) and the accuracy of the image recording is improved.

Figure 9C:
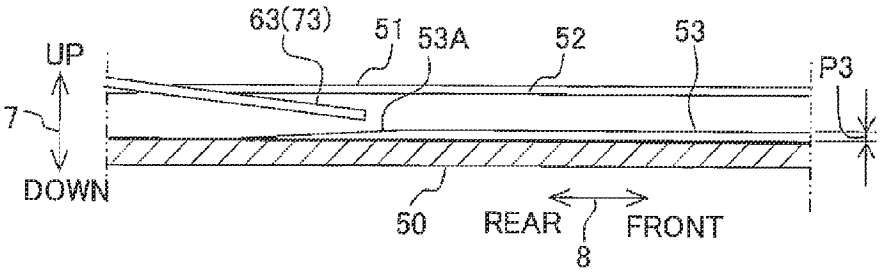
FIG. 9C is a vertical cross-sectional view of the platen 50.

The convex ribs 53 as shown in FIG. 4 are ribs for preventing the valley portions of the sheet 6 from being brought into sliding-contact with the upper surface of the platen 50 in a case that the sheet 6 swells by jetting a large amount of ink thereon, for example, a case in which a photograph is printed on the sheet 6, other than the glossy paper sheet, such as the regular paper sheet and a thick paper sheet. Each of the convex ribs 53 extends in the transport direction 19 from the position below downstream ends (front ends in the front-rear direction 8) of the contact portions 63, 73 in the transport direction 19. Each of the convex ribs 53 is positioned between the first ribs 51 in the left-right direction 9. As shown in FIG. 9C, each of the convex ribs 53 has an inclined surface 53A, which is more inclined upward toward the transport direction 19, at an end portion thereof on the upstream side in the transport direction 19. The inclined surface 53A is positioned on the lower side of the contact portion 63 to prevent the transported sheet 6 from being caught on the convex rib 53. A projection amount P3 of each of the convex ribs 53 from the upper surface of the platen 50 is set so that the upper ends of the abutting ribs 63A, 73A are positioned below the lower ends (front ends in the front-rear direction 8) of the abutting ribs 63A, 73A.

Figure 8B:
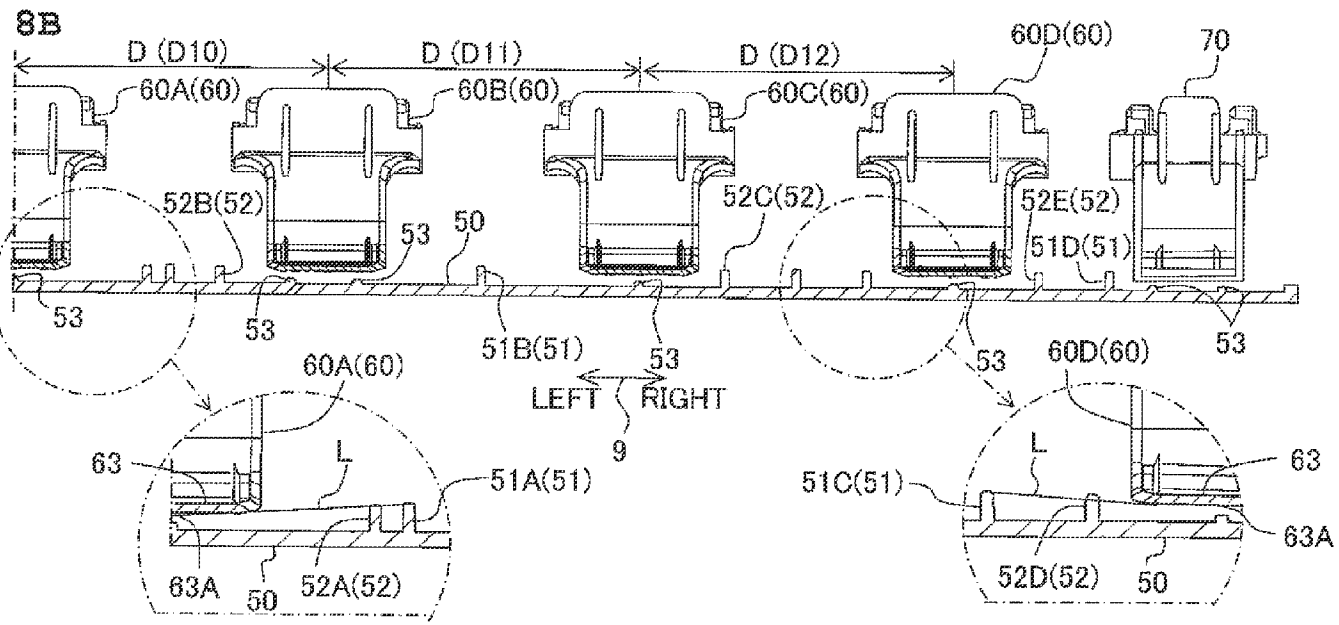

As shown in FIG. 8B, one convex rib 53 is disposed on a front side at the center of the contact member 60A in the left-right direction 9. The contact member 60A is arranged at a position which is the center of the platen 50 in the left-right direction 9. Two convex ribs 53 separated in the left-right direction 9 are disposed on a front side of the contact member 60B. The contact member 60B is disposed adjacently on the right side of the contact member 60A disposed at the center of the platen 50 in the left-right direction 9. One convex rib 53 is disposed on a front side at the center of each of the contact members 60D, 60E in the left-right direction 9. Two convex ribs 53 separated in the left-right direction 9 are disposed on a front side of the contact member 70. The sheet 6 in the undulant state swells, for example, by jetting the large amount of ink thereon and makes contact with the convex ribs 53 at the valley portions thereof in a case that the valley portions are lowered. Accordingly, the valley portions of the sheet 6 are prevented from being brought into sliding-contact with the platen 50. As a result, the change (loss) of the waveform and increase in the transport resistance can be avoided, and decrease of the accuracy of the image recording may be suppressed. The reason why the two convex ribs 53 are provided with respect to the contact member 60B and the contact member 70 is that the convex ribs 53 can support both of two kinds of sheets 6 (for example, post card and L-size, legal size and A4 size) having slightly different lengths in the left-right direction 9.

Figure 10B:
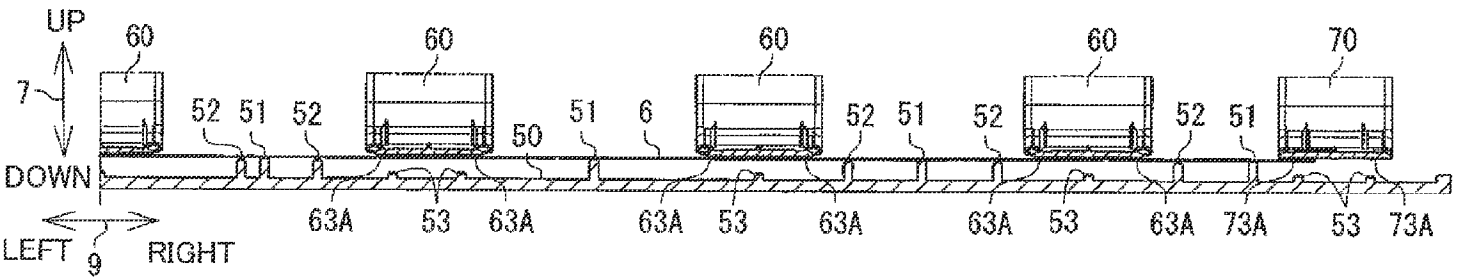
FIG. 10B is a view showing a state in which a sheet 6 having great difficulty in bending is transported.

By the way, the platen 50 is rotatably provided so that the sheet 6 having great difficulty in bending, such as the glossy paper sheet (see FIG. 10B) can be transported without being in the undulant state. An explanation will be made in detail. As shown in FIG. 10A, the platen 50 is rotatably supported by the rotation shaft 38A of the paper discharge rollers 38 at the front end portion in the front-rear direction 8. Thus, the rear end portion of the platen 50 in the front-rear direction 8 is displaceable in an up-down direction. The platen 50 is rotated between the first position, as shown in FIG. 8B, at which the upper end of each of the first ribs 51 is positioned over or above the lower ends (front ends in the front-rear direction 8) of the abutting ribs 63A, 73A and the second position, as shown in FIG. 10B, at which the upper end of each of the first ribs 51 is positioned below the lower ends of the abutting ribs 63A, 73A.

As shown in FIG. 10A, a coil spring 113 (an example of a biasing member of the present teaching), which urges or biases the platen 50 toward the first position (upward), is disposed on a lower side of the rear end portion of the platen 50 in the front-rear direction 8. A lower end of the coil spring 113 is supported while being brought in contact with an intermediate plate 112 provided in the unillustrated frame. An upper end of the coil spring 113 makes contact with the lower surface of the platen 50. The platen 50 is urged or biased toward the first position (upward) by the coil spring 113 to be in the first position by being brought in contact with the holder 114 which holds the driven roller 36 rotatably. In a case that the sheet 6 having the great difficulty in bending, such as the glossy paper sheet, is transported, the platen 50 is rotated, by the sheet 6, from the first position to the second position. Details will be described later.

[Operation of Embodiment]

Hereinbelow, an explanation will be made about operation of the ink-jet recording apparatus 10 at the time of recording the image on the sheet 6 which can bend with ease, such as the regular paper sheet, operation of the ink-jet recording apparatus 10 at the time of recording the image on the sheet 6 having the great difficulty in bending, such as the glossy paper sheet, and operation of the ink-jet recording apparatus 10 at the time of recording the image on the sheet 6 which is thicker than the regular paper sheet, such as the thick paper sheet, in that order.

At first, an explanation will be made about the operation of the ink-jet recording apparatus 10 at the time of recording the image on the sheet 6 which can bend with ease, such as the regular paper sheet, with reference to FIGS. 2 and 9. The sheet 6 placed on the paper feeding tray 21 is positioned with respect to the center line of the sheet by the side-guide mechanism 80. The sheet 6 subjected to positioning (subjected to positional adjustment) is fed to the transport path 31 by the feed roller 43. The fed sheet 6 is transported by the pair of transport rollers 34. The front end of the sheet 6, which has passed through the nip position of the pair of transport rollers 34, is guided to the contact portions 63, 73 by the guide ribs 69A, 79A of the contact members 60, 70. Since the sheet 6 is a sheet which can bend with ease, such as the regular paper sheet, the sheet 6 is supported by the first ribs 51 and the second ribs 52 in a state that the platen 50 is hardly rotated, is forced downward by the contact members 60, 70, and is made to be in the undulant state. The sheet 6 is positioned with respect to the center line. Since the contact members 60, 70, the first ribs 51, and the second ribs 52 are disposed to be bilaterally symmetric with reference to the center line of the platen 50 in the left-right direction 9, the sheet 6 is made to be in the bilaterally symmetric waveform. Further, all of the distances D1 to D4 between the first ribs 51 have the same distance D and each of the contact members 60 is arranged between the first ribs 51 disposed adjacently to each other. Thus, the sheet 6 is made to be in the undulant state in which each distance between the top portion of each peak and the top portion of each valley is uniform. Further, the sheet 6 is made to be in the undulant state by the second ribs 52 in which the radius of curvature of each wave of the waveform on the side closer to the center in the left-right direction 9 is smaller than the radius of curvature of each wave of the waveform on the side away from said center portion.

The sheet 6 in the undulant state becomes to have the difficulty in bending and is transported in a state that bending of the sheet 6 is suppressed. In a case that the front end portion of the sheet 6 arrives at the position below the nozzles 47 (FIG. 3B) of the recording head 46, rotation of the transport roller 35 is stopped. Thereafter, printing of one line is performed by jetting the ink droplets on the sheet 6 from the nozzles 47 while the carriage 48 is reciprocatively moved in the left-right direction 9. In this situation, the ink droplets are jetted from the recording head 46 taking the distance between the sheet 6 and the nozzles 47 which periodically changes depending on the waveform of the sheet 6 into consideration. Noted that as to whether or not the sheet 6 is the regular paper sheet etc., which can bend with ease is judged by information included in a printing instruction. After the printing of one line is performed, the transport roller 35 is rotated and the sheet 6 is transported by a distance corresponding to one line. The image is recorded on the sheet 6 by alternately repeating the printing of one line and the transport of the sheet 6 by the distance corresponding to one line. After the image is recorded, the sheet 6 is discharged to the paper discharge tray 29 by the pair of paper discharge rollers 37.

Next, an explanation will be made about the operation of the ink-jet recording apparatus 10 at the time of recording the image on the sheet 6 having the great difficulty in bending, such as the glossy paper sheet, with reference to FIGS. 2 and 10. The sheet 6 placed on the paper feeding tray 21 is fed to the transport path 31 by the feed roller 43 and is transported by the pair of transport rollers 34. The front end of the sheet 6, which has passed through the nip position of the pair of transport rollers 34, is guided to the contact portions 63, 73 by the guide ribs 69A, 79A of the contact members 60, 70. Since the sheet 6 is a sheet having the great difficulty in bending, such as the glossy paper sheet, the platen 50 is rotated, by the sheet 6, from the first position to the second position. Then, as shown in FIG. 10B, the sheet 6 is transported without being in the undulant state. Thereafter, the image is recorded on the sheet 6 by the recording head 46. Since the sheet 6 is not in the undulant state, the ink droplets are jetted by the recording head 46 in a state that the distance between the sheet 6 and the nozzles 47 (FIG. 3B) in the up-down direction 7 is uniform. Noted that as to whether or not the sheet 6 is the glossy paper sheet etc., having the great difficulty in bending is judged by information included in the printing instruction. Alternatively, a sensor which detects the thickness of the sheet 6 may be provided. The sheet 6 on which the image has been recorded is discharged on the paper discharge tray 29 by the pair of paper discharge rollers 37. In a case that the sheet 6 passes through the contact portions 63, 73, the platen 50 in the second position is returned to be in the first position by urging force of the coil spring 113.

Figure 11A:
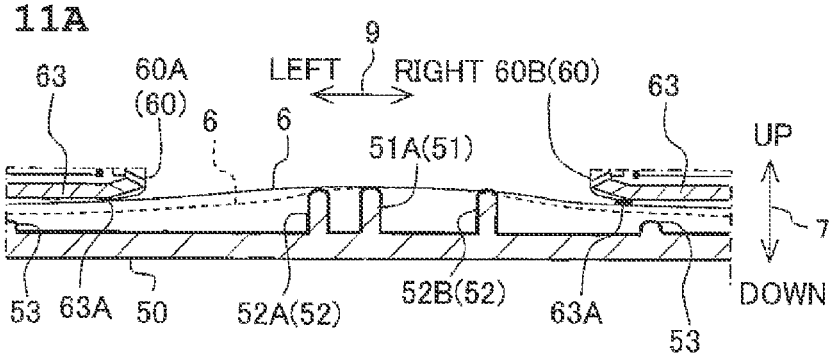
FIGS. 11A to 11D illustrate the operation of rotation of the platen 50, where
Figure 11B:
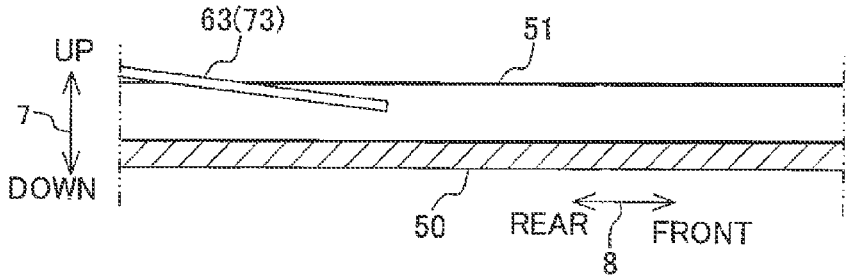
Figure 11C:
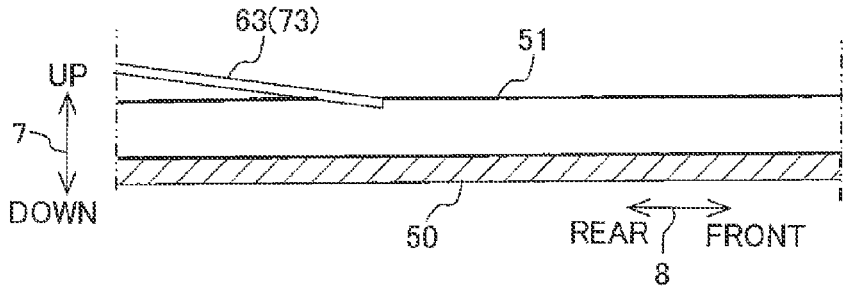
Figure 11D:
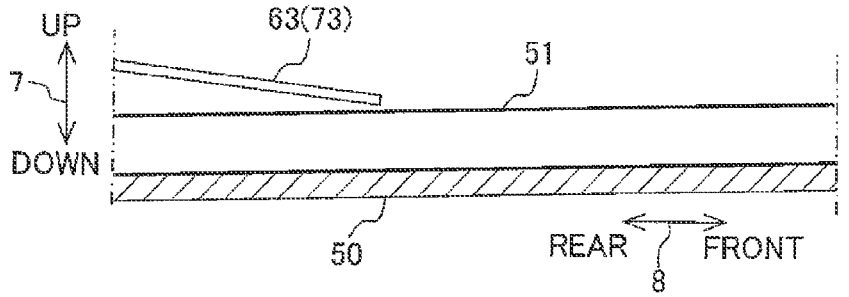

Next, an explanation will be made about the operation of the ink-jet recording apparatus 10 at the time of recording the image on the sheet 6 which is thicker than the regular paper sheet, such as the thick paper sheet, with reference to FIGS. 2 and 11. The sheet 6 placed on the paper feeding tray 21 is fed to the transport path 31 by the feed roller 43 and is transported by the pair of transport rollers 34. The front end of the sheet 6, which has passed through the nip position of the pair of transport rollers 34, is guided to the contact portions 63, 73 by the guide ribs 69A, 79A of the contact members 60, 70. Since the sheet 6 is a sheet which is thicker than the regular paper sheet, the platen 50 is slightly rotated by the sheet 6 to be in the position between the first position and the second position as shown in FIG. 11C. Noted that the first position is shown in FIG. 11B and the second position is shown in FIG. 11D. Then, as depicted by a solid line in FIG. 11A, the sheet 6 is made to be in a gentle waveform (waveform having small amplitude) as compared with a case of the regular paper sheet depicted by broken lines, and then is transported. The ink droplets are jetted by the recording section 45, assuming that the sheet 6 is made to be in the gentle waveform. In particular, although the distance between the sheet 6 and the nozzles 47 (FIG. 3B) periodically changes, the ink droplets are jetted by the recording head 46 assuming that the amount of change is smaller than the case of the regular paper sheet. As to whether or not the sheet 6 is the thick paper sheet etc. is judged by information included in the printing instruction. The sheet 6 on which the image has been recorded by the recording head 46 is discharged on the paper discharge tray 29 by the pair of paper discharge rollers 37. In a case that the sheet 6 passes through the contact portions 63, 73, the platen 50 in the position between the first position and the second position is returned to be in the first position by the urging force of the coil spring 113.

[Effect of Embodiment]

In this embodiment, in a case that the sheet 6 is made to be in the undulant state, the part of the sheet 6 is supported by the second ribs 52 and the waveform is adjusted by making the radius of curvature of each wave of the waveform on the side closer to the center portion of the sheet 6 in the left-right direction 9 smaller than the radius of curvature of each wave of the waveform on the side away from said center portion. Accordingly, the uniformity of the rigidity of the sheet 6 in the left-right direction 9 is improved. Thus, the waveform of the sheet 6 is less likely to be changed (lost) and thereby improving the accuracy of the image recording.

Further, the waveform can be adjusted depending on the arrangement position of each of the second ribs 52, thereby making it easier to design the platen 50.

Further, since the first rib 51 and the second rib 52 are disposed to be bilaterally symmetric with reference to the center line of the platen 50 in the left-right direction 9, the sheet 6 can be in the bilaterally symmetric waveform. As a result, the waveform of the sheet 6 is less likely to be changed (lost) and thereby improving the accuracy of the image recording.

Further, the cycle of the waveform is made to be uniform by making each distance between the top portions of the peaks in the undulant state (or each distance between the top portions of the valleys in the undulant state) uniform; and each distance between the top portion of each of the peaks and the top portion of each of the valleys is made to be uniform. Thus, the control of the recording head 46 becomes easier.

Further, since the contact portions 63, 73 are provided so that the elastic deformation of each of the contact portion 63, 73 is possible, not only the waveform of each peak portion but also the waveform of each valley portion can be adjusted. As a result, the waveform of the sheet 6 is less likely to be changed (lost) and thereby improving the accuracy of the image recording.

By providing the platen 50 rotatably, regardless of the thickness or flexibility of the sheet 6, the various kinds of sheets 6, such as the regular paper sheet, the thick paper sheet, and the glossy paper sheet, are each transported and the image can be recorded on each of the sheets 6.

Further, even when the sheet 6 swells by jetting the large amount of ink thereon and the valley portions are lowered, the convex ribs 53 can suppress that the valley portions of the sheet 6 are brought into sliding-contact with the upper surface of the platen 50. As a result, the change (loss) of the waveform and the increase in the transport resistance of the sheet 6 can be avoided, and decrease of the accuracy of the image recording may be suppressed.

First Modified Embodiment

Figures 12A, 12B, 12C:
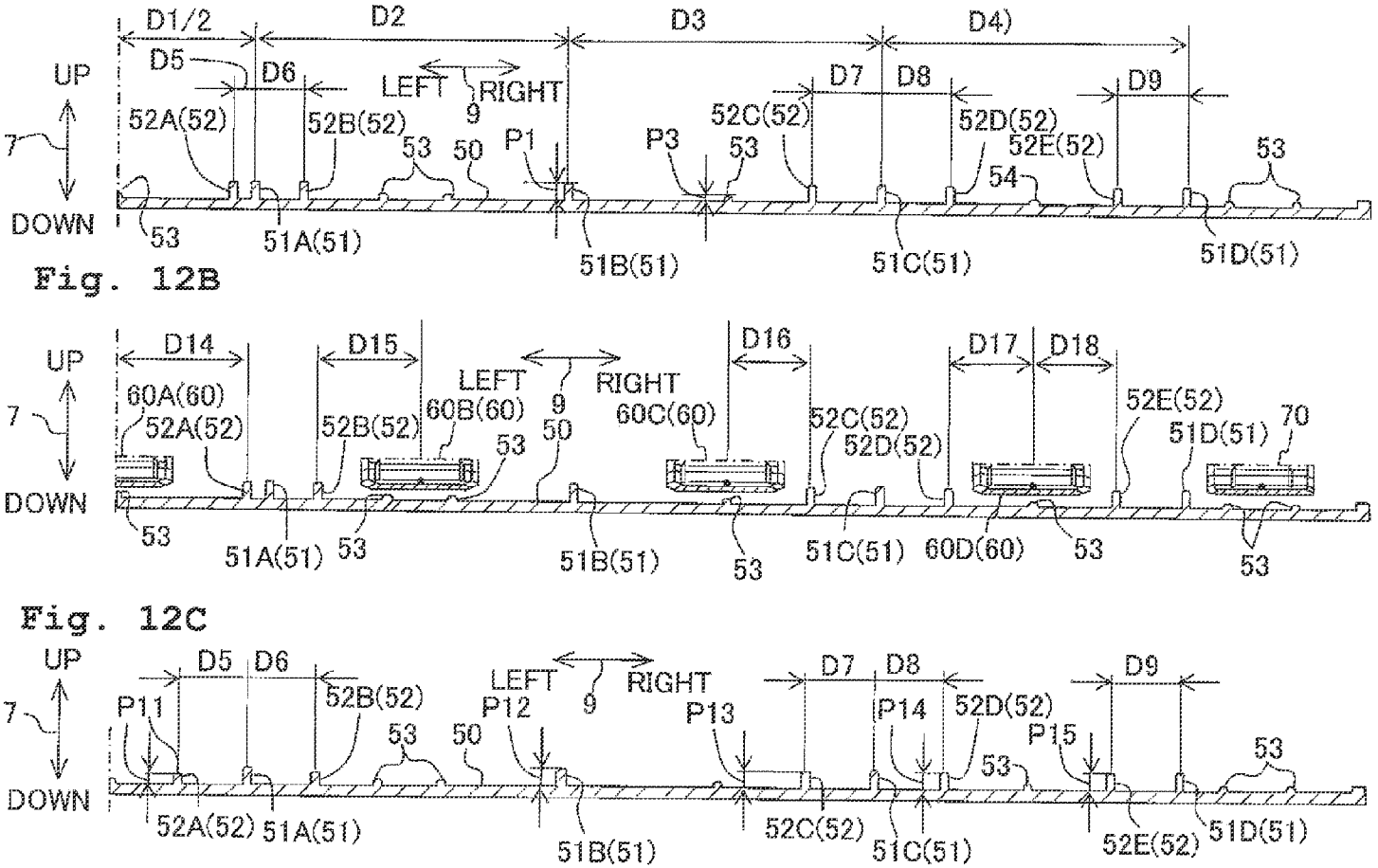
FIG. 12A is a cross-sectional view, of the platen 50, perpendicular to the front-rear direction 8 according to the first modified embodiment.
FIG. 12B is a cross-sectional view, of the platen 50 and the contact members 60, perpendicular to the front-rear direction 8 according to the third modified embodiment.
FIG. 12C is a cross-sectional view, of the platen 50, perpendicular to the front-rear direction 8 according to the fourth modified embodiment.

In the embodiment as described above, an explanation has been made about an example in which the distances D1 to D4 between the first ribs 51 have the same distance D (FIG. 8A) in order to make the control of the recording head 46 easy. However, as shown in FIG. 12A, the first ribs 51 may be arranged to have the relation of distance D1≤distance D2≤distance D3≤distance D4 (However, excluding distance D1=distance D2=distance D3=distance D4). The reason thereof is that the uniformity of the rigidity in the left-right direction 9 is improved in the sheets 6 in various sizes. For example, the distance D1 and the distance D2 are determined to have the relation of distance D1<distance D2 with reference to the sheet 6 having the small size. Next, the distance D3 and the distance D4 are determined to have the relation of distances D1, D2<distances D3, D4 for the sheet 6 having the large size. Similar to the embodiment as described above, each of the contact members 60 is disposed between the two first ribs 51 adjacent to each other. Other structures are the same as those of the embodiment as described above.

By arranging each of the first ribs 51 as described above, the uniformity of the rigidity in the left-right direction 9 can be improved in the sheets 6 in various sizes.

Second Modified Embodiment

In the first modified embodiment, an explanation has been made about an example of the arrangement of each of the second ribs 52 in a case that the image is recorded on the sheet 6 having the small size and the sheet 6 having the large size. In this modified embodiment, an explanation will be made about the arrangement of each of the first ribs 51 and each of the second ribs 52 in a case that the size of the sheet 6 is limited to a sheet 6 having a relatively large size, such as the A4 size and the legal size.

In FIG. 12A, the first ribs 51 are disposed to have the relation of distance D1<distance D2<distance D3<distance D4; and the second ribs 52 are disposed to have the relation of distance D5<distance D6<distance D7<distance D8. The end portions of the sheet 6 are more likely to be in the undulant state as compared with the center portion thereof in the left-right direction 9. Thus, by arranging the first ribs 51 and the second ribs 52 as described above, the rigidity of the sheet 6 in the left-right direction 9 can be made to be more uniform. Noted that, as a matter of course, the first ribs 51 and the second ribs 52 may be arranged in a similar manner to this modified embodiment, even when the image is recorded on the sheet 6 having the small size and the sheet 6 having the large size.

Third Modified Embodiment

In the above embodiment and the modified embodiments 1 and 2, an explanation has been made about an example in which the arrangement position of each of the second ribs 52 is determined based on each of the first ribs 51. However, as shown in FIG. 12B, the arrangement position of each of the second ribs 52 may be determined based on each of contact members 60. The second ribs 52 are disposed to have the relation of distance D14 between contact member 60A and second rib 52A≥distance D15 between contact member 60B and second rib 52B≥distance D16 between contact member 60C and second rib 52C≥distance D17 between the contact member 60D and second rib 52D≥distance D18 between contact member 60D and second rib 52E (however, excluding distance D14=distance D15=distance D16=distance D17). Other structures are the same as those of the embodiment as described above.

The radius of curvature of the wave can be smaller in the portion which has the longer distance between the contact member 60 and the second rib 52. Thus, by arranging each of the second ribs 52 as described above, the radius of curvature of the wave at the center portion of the sheet 6 in the left-right direction 9 can be smaller than the radius of curvature of the wave at each of the end portions, similar to the state shown in FIG. 9B. As a result, the uniformity of the rigidity of the sheet 6 in the left-right direction 9 can be improved.

Fourth Modified Embodiment

In the above embodiment, an explanation has been made about an example in which the radius of curvature of each wave of the waveform is adjusted so that all of the plurality of second ribs 52 have the same projection amount P2 (FIG. 8A) and the distances D5 to D9 (FIG. 8A) have distances different from one another. Noted that each of the distances D5 to D9 is a distance between each second rib 52 and the first rib 51 closest to each second rib 52 in the left-right direction 9. However, as shown in FIG. 12C, the radius of curvature of each wave of the waveform may be adjusted so that all of the distances D5 to D9, each of which is a distance between each second rib 52 and the first rib 51 closest to each second rib 52, have the same distance and the projection amounts P11 to P15 have different projection amounts. The second ribs 52 are provided to have the relation of projection amount P11 of second rib 52A≤projection amount P12 of second rib 52B≤projection amount P13 of second rib 52C≤projection amount P14 of second rib 52D≤projection amount P15 of second rib 52E (however, excluding P11=P12=P13=P14=P15).

Since all of the distances D5 to D9 have the same distance, the radius of curvature of the wave is smaller in the portion which has the smaller projection amount of the second rib 52. Thus, by arranging each of the second ribs 52 as described above, the radius of curvature of the wave at the center portion of the sheet 6 in the left-right direction 9 can be smaller than the radius of curvature of the wave at each of the end portions, similar to the state shown in FIG. 9B. As a result, the uniformity of the rigidity of the sheet 6 in the left-right direction 9 can be improved.

Fifth Modified Embodiment

In the modified embodiment 4 as described above, an explanation has been made about an example in which the arrangement position of each of the second ribs 52 is determined based on each of the first ribs 51. However, the arrangement position of each of the second ribs 52 may be determined based on each of the contact members 60. In particular, each of the second ribs 52A to 52E (FIG. 12C) is arranged to have the same distance between each second rib and the contact member 60 closest to each second rib. Also by arranging each of the second ribs as described above, the radius of curvature of the wave at the center portion of the sheet 6 in the left-right direction 9 can be smaller than the radius of curvature of the wave at each of the end portions, similar to the state shown in FIG. 9B. As a result, the uniformity of the rigidity of the sheet 6 in the left-right direction 9 can be improved.

Sixth Modified Embodiment

In the embodiment, an explanation has been made about an example in which the platen 50 is rotatably provided so that the sheet 6 having great difficulty in bending, such as the glossy paper sheet, is transported without being in the undulant state. In this modified embodiment, instead of providing the platen 50 rotatably, an example in which the contact members 60, 70 (FIGS. 5, 6) are provided rotatably will be explained.

Figure 13A:
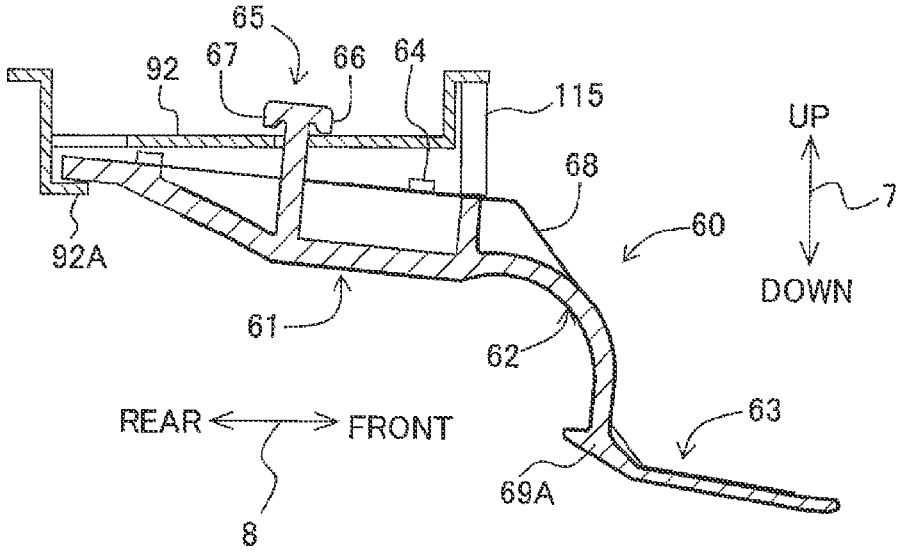
FIG. 13A is a vertical cross-sectional view of a state in which the contact member 60 of the sixth modified embodiment is disposed at a third position.
Figure 13B:
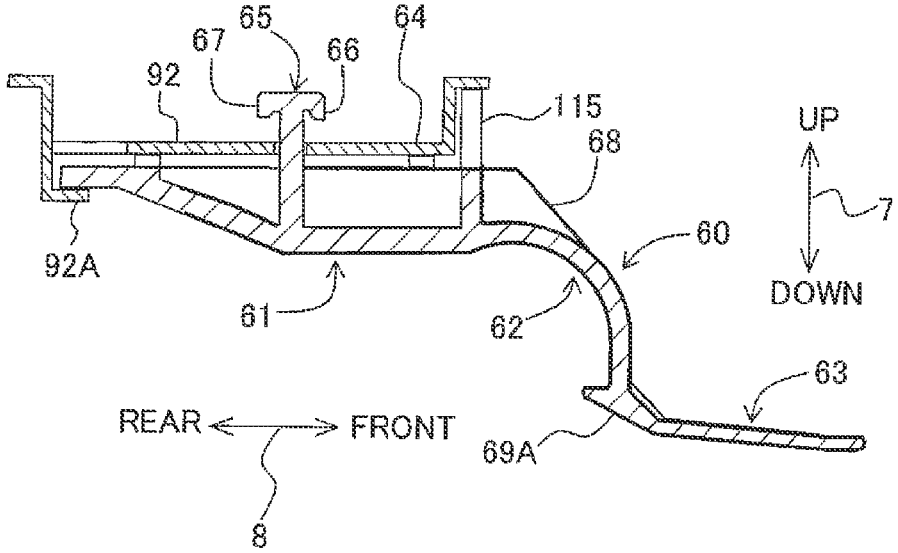
FIG. 13B is a vertical cross-sectional view of a state in which the contact member 60 is disposed at a fourth position.

As shown in FIG. 13, a receiving portion 92A which rotatably supports the rear end portion of each of the contact members 60, 70 in the front-rear direction 8 is provided in the guide rail 92. In the following description, an explanation will be made about the contact member 60 shown in FIG. 13. However, the same is applied to the contact member 70 as well.

Unlike the above embodiment, there is not provided the insertion projection 65 on the rear side in the front-rear direction 8. Further, the insertion projection 65 on the front side in the front-rear direction 8 has a length in the up-down direction 7 which is longer than that of the insertion projection 65 in the above embodiment. The contact member 60 is rotated, with the rear end portion thereof as an axis, between the third position (FIG. 13A) in which the claw 66 of the insertion projection 65 on the front side in the front-rear direction 8 makes contact with the upper surface of the guide rail 92 and the fourth position (FIG. 13B) in which the reinforcing rib 64 makes contact with the lower surface of the guide rail 92.

In a case that the contact member 60 is in the third position, the lower end (front end in the front-rear direction 8) of the abutting rib 63A is positioned below the upper end of the first rib 51. In a case that the contact member 60 is in the fourth position, the lower end of the abutting rib 63A is positioned over or above the upper end of the first rib 51. A coil spring 115 (an example of the biasing member of the present teaching) is disposed between the guide rail 92 and the front end portion of the attaching portion 61 in the front-rear direction 8. The coil spring 115 urges or biases the contact member 60 toward the third position (downward).

In a case that the sheet 6 (FIG. 10B) having the great difficulty in bending, such as the glossy paper sheet, is transported, the contact member 60 is rotated by the sheet 6 from the third position to the fourth position. The sheet 6 makes the contact member 60 be in the fourth position and is transported without being in the undulant state. In a case that the sheet 6 passes through the contact member 60, the contact member 60 in the fourth position is returned to be in the third position by the urging force of the coil spring 115. In a case that the sheet 6 which is thicker than the regular paper sheet, such as the thick paper sheet, is transported, the contact member 60 is rotated to the position between the third position and the fourth position. Similar to the case depicted by the solid line in FIG. 11A, the sheet 6 is made to be in the gentle waveform (waveform having small amplitude) as compared with the case of the regular paper sheet depicted by broken lines and then is transported. Therefore, it is possible to transport the sheet 6 and to record the image thereon, regardless of the thickness or flexibility of the sheet 6.

In this modified embodiment, the contact members 60, 70 are rotated depending on the thickness or flexibility of the sheet 6. Thus, it is possible to transport the sheet 6 and to record the image thereon, regardless of the thickness or flexibility of the sheet 6.

In this modified embodiment, an explanation has been made about an example in which the contact members 60, 70 are provided rotatably. However, the contact members 60, 70 may be provided to be movable entirely in the up-down direction 7.

Other Modified Embodiments

In the above embodiment, an explanation has been made about an example in which the plurality of second ribs 52 are provided. However, it is also allowable to adopt a construction in which at least one second rib 52 is provided.

In the above embodiment, an explanation has been made about an example in which the convex ribs 53 are provided in the platen 50. However, the convex ribs 53 are provided for a case in which the sheet 6 swells, greater than expected, by jetting the ink thereon, and the like. Thus, even if each of the convex ribs 53 is not provided, it is possible to improve the uniformity of the rigidity of the sheet 6 in the left-right direction 9 by the second rib 52 and to improve the accuracy of the image recording.

In the above embodiment, an explanation has been made about an example in which each of the convex ribs 53 is provided to extend in the transport direction 19 from the downstream end of each of the contact portions 63 in the transport direction 19. However, each of the convex ribs 53 may be provided to extend in the transport direction 19 from the position on the upstream side of each of the contact portions 63 in the transport direction 19 to the position on the downstream side of each of the contact portions 63.

In the above embodiment, an explanation has been made about an example in which two kinds of contact members (contact members 60, 70) are used. However, only one of the contact members 60, 70 may be used.

In the above embodiment, an explanation has been made about an example in which the guide ribs 69A and the abutting ribs 63A are provided in the contact portion 60. However, the guide ribs 69A and the abutting ribs 63A may not be provided in the contact portion 60. In this case, the sheet 6 is guided to each of the contact portions 63 by each of the guide surfaces 69. Further, the sheet 6 is held by the lower surface of each of the contact portions 63. The same is applied to the contact member 70 as well.

In the above embodiment, an explanation has been made about an example in which the transport path 31 has the curved path 32. However, the transport path 31 may be formed only of the straight path 33. Alternatively, the transport path 31 may be formed so that a curved path which curves in a form different from the curved path 32 of the above embodiment and the straight path are included, as needed.

In the above embodiment, an explanation has been made about an example in which the rear end portion of the platen 50 in the front-rear direction 8 is rotated to be displaced in the up-down direction. However, the platen 50 may be provided to be movable entirely in the up-down direction 7 while maintaining a horizontal state.

In the above embodiment, an explanation has been made about an example in which the plurality of contact members 60, 70 are attached to the guide rail 92. However, it is also allowable to adopt a construction in which one contact member having the plurality of contact portions 63 is attached to the guide rail 92. Further, the contact members 60, 70 may be configured integrally with the guide rail 92 by a resin, provided that strength of the guide rail 92 is secured.

In the above embodiment, an explanation has been made about an example in which the distances D1 to D4 between the plurality of first ribs 51 have the same distance. However, the distance D1 may be slightly longer than the distances D2 to D4 taking the sheet 6 which is thick and has a narrow width in the left-right direction 9, such as the postcard, into consideration.

It is possible to appropriately combine the above embodiment and the modified embodiments thereof, as needed, except for any combination which cannot be realized.

What is claimed is:

1. An ink-jet recording apparatus comprising:

a roller pair configured to transport a sheet in a first direction;

a platen disposed downstream of the roller pair in the first direction and including a plurality of ribs spaced apart from each other in a second direction perpendicular to the first direction; and a plurality of contact portions spaced apart from each other in the second direction, wherein each downstream end of the plurality of contact portions in the first direction extends toward the platen, and wherein the plurality of ribs includes an inclined surface that is inclined upwardly, relative to the platen, in the first direction, wherein the downstream end of the at least one of the plurality of contact portions overlaps the at least a portion of the inclined surface in a third direction perpendicular to the first and second directions.

2. The ink-jet recording apparatus according to claim 1, wherein the inclined surface forms an upstream end of at least one of the plurality of ribs in the first direction.

3. The ink-jet recording apparatus according to claim 1, wherein each downstream end of the plurality of contact portions are located closer to the platen, in the third direction, than a nip point of the roller pair.

4. The ink-jet recording apparatus according to claim 1, wherein the plurality of ribs are spaced apart from the plurality of contact portions in the third direction.

5. The ink-jet recording apparatus according to claim 1, further comprising a recording head overlapping the platen in the third direction and including ink nozzles, and wherein each downstream end of the contact portion is disposed between the roller pair and the nozzles in the first direction.

6. The ink-jet recording apparatus according to claim 1, wherein each of the plurality of contact portions is pivotable toward and away from the platen.

7. An ink-jet recording apparatus comprising:

a roller pair configured to transport a sheet in a first direction;

a platen disposed downstream of the roller pair in the first direction and including a plurality of ribs spaced apart from each other in a second direction perpendicular to the first direction, wherein the plurality of ribs includes a plurality of inclined surfaces that are inclined upwardly, relative to the platen, in the first direction; and a plurality of contact portions spaced apart from each other in the second direction, wherein a downstream end, in the first direction, of each of the plurality of contact portions is configured to press the sheet towards a respective one of the plurality of inclined surfaces of the plurality of ribs in a third direction perpendicular to the first and second directions.

8. An ink-jet recording apparatus comprising:

a roller pair configured to transport a sheet in a first direction;

a platen disposed downstream of the roller pair in the first direction and including a plurality of ribs spaced apart from each other in a second direction perpendicular to the first direction; and a plurality of contact portions spaced apart from each other in the second direction, wherein each downstream end of the plurality of contact portions in the first direction extends toward the platen, and wherein the plurality of ribs includes an inclined surface that is inclined upwardly, relative to the platen, in the first direction, wherein the downstream end of at least one of the plurality of contact portions is disposed at a same position in both of the first and second directions as at least a portion of the inclined surface.

* * * * *